United States Patent [19]

Hoener, Jr.

[11] 3,942,213

[45] Mar. 9, 1976

[54] WINDOW WALL WASHING DEVICE FOR HIGH RISE BUILDINGS

[75] Inventor: Ralph H. Hoener, Jr., University City, Mo.

[73] Assignee: H. H. Robertson Company, Pittsburgh, Pa.

[22] Filed: July 31, 1973

[21] Appl. No.: 384,284

Related U.S. Application Data

[63] Continuation-in-part of Ser. No. 229,846, Feb. 28, 1972, abandoned, which is a continuation-in-part of Ser. No. 130,616, April 2, 1971, abandoned.

[52] U.S. Cl. ..... 15/302; 15/346; 15/380

[51] Int. Cl. ..... A47l 1/04

[58] Field of Search..... 15/302, 50 R, 320, 346, 15/380, 345

[56] References Cited

UNITED STATES PATENTS

| | | | |
|---|---|---|---|
| 2,916,761 | 12/1959 | Oberg | 15/346 X |
| 3,604,049 | 9/1971 | Hetman | 15/302 |

*Primary Examiner*—Robert L. Bleutge
*Assistant Examiner*—C. K. Moore
*Attorney, Agent, or Firm*—Harry B. Keck

[57] ABSTRACT

A wall washing device is provided with self contained liquid spray means, wall and window surface scrubbing means such as brushes or sponges and means for providing a curtain of high velocity, in-rushing air around a wall washing sight. This air serves to dry the freshly laundered wall and window surfaces and also to confine the washing liquids and retard their egress from the wall washing sight. The high velocity, in-rushing air curtain is delivered through a perimeter aperture which is spaced-apart from the window/wall surfaces, in accordance with a first embodiment; and is provided by forceably drawing atmospheric air inwardly at the perimeter of the wall washing sight in accordance with a second embodiment. The device is adapted to ascend and descend between a pair of vertical mullions of the building. The device is further adapted to provide its wall and window washing function during either the ascending or descending runs or both. The device moreover is intended for remotely controlled operation.

56 Claims, 34 Drawing Figures

10
100
113
16
118
57
24
24
42
108
110
22
22
111
112
115
85
114
11
116
118
19
20
117
104
101
103
59
103
38
21
107
13
13
53
19
20
104
11
109
50
102
54
18
23
23
10

192
163
195
194
180
181
178
193
154
20
183
21
39
190
219
161
218
187
14
182
165
48
160
281
223
220
222
225
224
184
206
239
212
214
235
51
54
M
229
234
231
215
217b
230
217a
216
19
205
201
202
200
199
198
196
197
165
167
166
85
240
232
233
241
237
18
238
236

WINDOW WALL WASHING DEVICE FOR HIGH RISE BUILDINGS

CROSS REFERENCES TO RELATED APPLICATIONS (IF ANY)

This application is a continuation-in-part of copending application Ser. No. 229,846 filed Feb. 28, 1972 now abandoned which was a continuation-in-part of then copending application Ser. No. 130,616 filed Apr. 2, 1971, now abandoned, and assigned to the assignee of this invention.

BACKGROUND OF THE INVENTION

1. Field of the Invention

The invention relates to window and wall washing devices for the exterior window and wall surfaces of high-rise buildings. More particularly the present invention concerns a unit which in operation is spaced apart from the exterior surfaces of the walls and windows of a high-rise building and which is provided with a perimeter air curtain to retard the egress of washing liquids from the space between the unit and the exterior window and wall surfaces.

2. Description of the Prior Art

High-rise buildings having fixed glazing are relatively new. Prior to the past decade, most, if not all, high-rise buildings employed movable glazing which permitted window cleaning to be conducted from the inside of the buildings. Within the past decade, fixed glazing has become popular and has created a need for other methods of washing the outside surfaces of the glazing. There is also a need for washing the outside surface of the infill panels between the fixed glazing in typical high-rise buildings. Numerous devices have been proposed for accomplishing the window washing by means of unmanned units which traverse the exterior surfaces of the buildings; some units are self-propelled; others are raised and lowered by means of cables connected to the top of the building. Such units have included means for delivering cleaning liquid such as water or detergent solutions, and have included means for scrubbing the window wall such as brushes and/or sponges and have included means for retarding the egress of cleaning liquid in the form of aqueegee blades. Such devices are shown in U.S. Pat. Nos. 3,292,193 (LITTEN, Dec. 20, 1966); 3,298,052 (NOLFE, January, 1967); 3,425,082 (HETMAN, Feb. 4, 1969); 3,344,454 (MIKALSON, Oct. 3, 1967); 3,497,902 (HARTIGAN, Mar. 3, 1970). To date such devices have experienced only limited commercial acceptance.

In some instances because of discontinuities in the building exterior surface unmanned wall-washing units have become immobilized at locations many floors above street level requiring hazardous rescue operations in high winds by workmen on scaffolds or ropes on the exterior of the buildings.

SUMMARY OF THE INVENTION

A mobile cleaning device for an exterior building wall is provided with a housing presenting a forward edge which defines a wall washing sight and which is spaced-apart from the building exterior wall. The device ascends or descends a defined portion (wall washing sight) of the wall between a pair of vertical mullions. The device includes suitably patterned spray means within the housing for directing cleaning liquids outwardly through the wall washing sight against the building exterior wall. The device includes agitating means within the housing which extends through the wall washing sight into engagement with the building exterior wall for scrubbing the wall surface. The device further includes means for providing a high velocity, in-rushing air curtain around the wall washing sight to preclude substantial egress of cleaning liquids from the wall washing sight and to direct any cleaning liquids away from the building exterior wall surface back into the mobile cleaning device through the wall washing sight.

In accordance with one embodiment of this invention, the device is provided with a hollow perimeter duct defined in part by the boundary walls of the housing. The hollow perimeter duct includes a perimeter aperture which is spaced apart from the building exterior wall and which directs the aforesaid high velocity air curtain against the building exterior wall surface.

In accordance with an alternative embodiment of this invention, the housing presents a forward edge which is spaced apart from the building exterior wall surface. The aforesaid high velocity, in-rushing air curtain is provided by forceably drawing atmospheric air inwardly at the perimeter of the wall washing sight.

The housing provides an enclosed chamber extending rearwardly from the wall washing sight for recovering the cleaning liquids and for recovering a portion of the entrained air. From the enclosed chamber the cleaning liquids are recirculated for reuse through a liquid reservoir carried by the mobile cleaning device.

The air is withdrawn from the enclosed chamber at a relatively low velocity, through a moisture removing device. In the first embodiment, the air withdrawn from the enclosed chamber is recirculated through the hollow perimeter duct. In accordance with the alternative embodiment, all of the air withdrawn from the enclosed chamber may be vented directly to the atmosphere; or a major portion of the air withdrawn from the enclosed chamber may be directed to a hollow chamber through a linear aperture thereof to provide a second high velocity air curtain against the building exterior wall surface for drying the same.

In accordance with a further alternative embodiment of this invention, the housing presents a linear aperture extending entirely across the bottom of the chamber which directs the high-velocity in-rushing air curtain against the building exterior wall surface. The housing also presents a compartment extending entirely across the top of the chamber which is defined, in part, by spaced squeegees. The squeegees are inclined with respect to the horizontal and are disposed in wiping engagement with the building exterior wall surface during a washing cycle. The compartment is maintained at a pressure level above that of the chamber. The compartment arrangement is such that when the first squeege is distorted by engagement with a protrusion, such as a horizontal muntin, at least one high-velocity in-rushing gas stream is created. The inclination of the squeegees is such that the high-velocity in-rushing gas stream moves across the entire width of the muntin whereby essentially all of the excess cleaning liquid is removed from the muntin and returned to the chamber.

Suitable building exterior wall engaging elements such as wheels are provided to engage the building mullions in a manner such that the desired spaced apart relationship between the perimeter frame and the window wall surface is maintained. It is a matter of choice whether (a) the mobile cleaning device is self-powered and driven by its own self-contained motive force or whether (b) the mobile cleaning device preferably is operated through a suitable cable drive mechanism which is provided at the top of the building and which includes cable connections between the drive mechanism and the mobile cleaning device. In the preferred embodiment, the weight of the mobile cleaning device does not include the prime mover required for mobility. Electrical power preferably is delivered to the device by means of cables associated with the driving cables for the device, although electrical power sources such as batteries of inertial prime movers (fly wheels) may be included with the device.

It is a feature of the first embodiment of the present mobile cleaning device that it can perform its building exterior wall washing function in either the ascending or the descending movement over the building exterior wall surface. It is intended that suitable transfer apparatus will be provided at the base of the building and at the top of the building to permit the transfer of a mobile cleaning device from one location between the first pair of vertical mullions to a new location between a different pair of vertical mullions so that the device can perform its wall washing function in a semi-continuous fashion.

The alternative embodiment of the present mobile cleaning device performs its building exterior wall washing function during the descending movement over the building exterior wall surface. It is intended that suitable transfer apparatus will be provided at the top of the building to permit the transfer of the mobile cleaning device from one location between a first pair of vertical mullions to a new location between a different pair of vertical mullions.

As an alternative, either of the mobile cleaning devices may have self-contained apparatus for transferring the device into engagement with a different pair of vertical mullions. Means are provided within the mobile cleaning device for removing and replacing spent cleaning liquids from the liquid reservoir.

While an oscillating brush is provided as a preferred scrubbing means, it is contemplated that rotary brushes might be employed and further contemplated that oscillating or rotary sponges might be substituted for the brushes.

DESCRIPTION OF THE PREFERRED EMBODIMENT(S)

Figure 1:
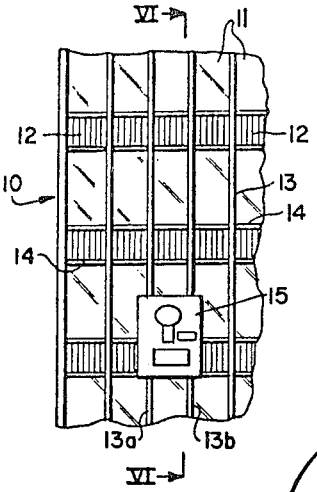
FIG. 1 is a fragmentary illustration of a typical modern high-rise building illustrating the present mobile cleaning device in a typical operating disposition.

A typical modern building 10 is illustrated in FIG. 1 having an exterior wall consisting of windows 11 and infill panels 12 and horizontally spaced apart vertical mullions 13. Horizontal muntins 14 are normally provided at the juncture of the windows 11 and infill panels 12. Customarily the muntins 14 project outwardly from the plane of the exterior wall of the building 10. The windows 11 in modern high-rise buildings are customarily fixed glazing. The infill panels 12 are fabricated from a variety of materials some of which include porcelain-enameled aluminum sheets, porcelain-enameled steel sheets, anodized aluminum sheets, ceramic tile, fiber-reinforced resinous sheets, painted steel sheets, opaque glass sheets, slabs of marble, granite and other naturally occurring materials and synthetic simulations of marble, granite and natural materials, weathering steel sheets, painted steel sheets, stainless steel sheets, and the like.

The present mobile cleaning device 15 is positioned between a pair of adjacent vertical mullions 13*a*, 13*b*. By suitable means, not shown, but hereinafter described, the mobile cleaning device 15 is caused to ascend or descend over the exterior wall of the building 10 from top to bottom (or bottom to top) between each adjacent pair of vertical mullions in sequence.

Figure 2:
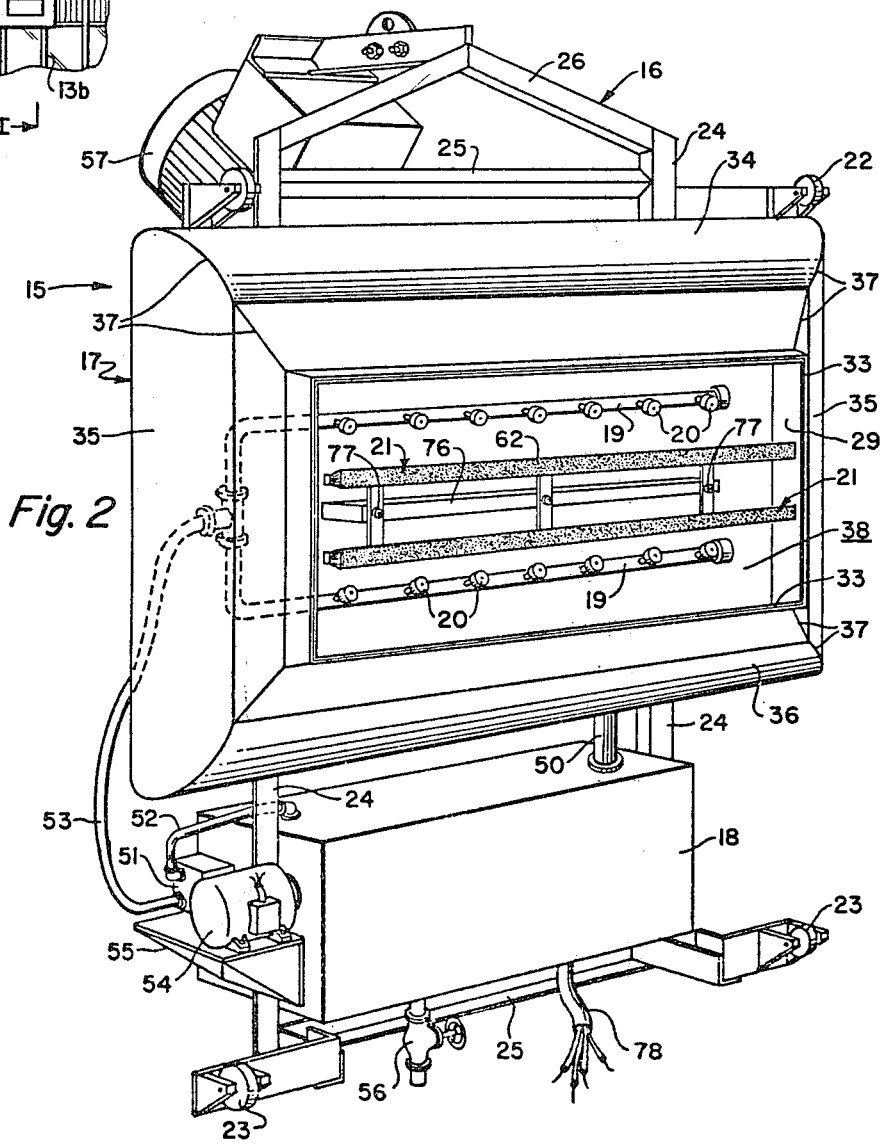
FIG. 2 is a perspective illustration of the present mobile cleaning device as viewed from the building exterior wall surface.

According to FIG. 2, the mobile cleaning device 15 includes:

- a chassis 16;
- a hollow perimeter duct 17;
- a housing 59;
- a liquid reservoir 18;
- liquid manifolds 19 having plural spray nozzles 20;
- scrubbing means such as oscillating brushes 21;
- forwardly extending building engaging elements such as upper wheels 22 and lower wheels 23.

The chassis 16 includes vertical frame elements 24, horizontal frame elements 25 and inclined frame elements 26. The hollow perimeter duct 17 is secured to the vertical frame elements 24 in any suitable fashion as by bolts, rivets, welding. As better seen in FIG. 3, the hollow perimeter duct 17 is formed from sheet metal which is generally tubular and has a rounded portion 28, an interior wall portion 29 and an exterior wall portion 30. The interior wall portion 29 has a forward edge 31; the exterior wall portion 30 has a forward edge 32. The space between the forward edges 31, 32 constitutes a perimeter aperture 33. It will be observed in FIG. 2 that the perimeter aperture 33 forms an enclosed rectangle which defines the sight of the active washing accomplished by the present mobile cleaning device 15.

The hollow perimeter duct 17 is formed from four individual sheet metal components including a top member 34, two side members 35 and a bottom member 36. The members 34, 35, 36 are beveled at their ends and are smoothly connected preferably by means of welding seams 37 along the abutting beveled ends.

Figure 3:
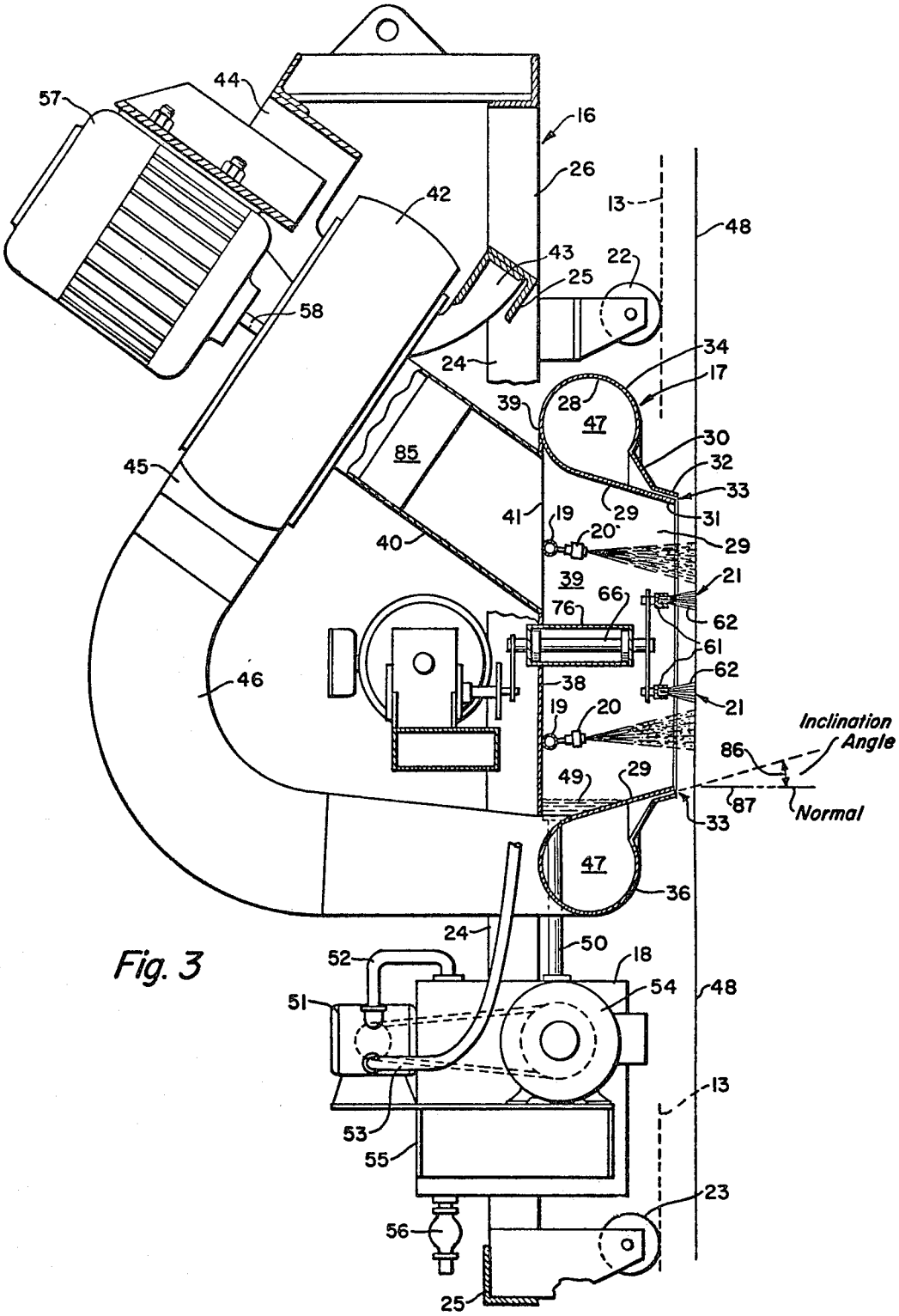
FIG. 3 is a side elevation view partly in cross-section showing the present mobile cleaning device in operating relation to a building exterior wall surface.

A vertical plate or rear wall 38 is provided along the back of the hollow perimeter duct 17 and is connected to the rounded portions 28 along its edges by means of suitable welds 27 one of which may be seen in FIG. 3 where the vertical plate 38 joins the top member 34. The interior wall portions 29 and the vertical plate 38 along with a portion of the rounded portions 28 constitute the boundary walls of the housing 59 which provides a chamber 39. An air removal conduit 40 communicates with the chamber 39 through an opening 41 in the vertical plate 38. The air removal conduit 40 feeds a centrifugal fan 42 at its inlet vortex. The centrifugal fan 42 is secured to the chassis 16 by means of suitable brackets 43, 44. The tangential air delivery opening 45 of the centrifugal fan 42 communicates with an air delivery conduit 46 which in turn communicates with the bottom member 36 of the perimeter duct 17. It will be observed the perimeter duct 17 has a continuous chamber 47 which serves as a pressurized air manifold to receive pressurized air from the conduit 46 and to release air at high velocities through the perimeter aperture 33. It will further be observed that the interior walls 29 and the exterior walls 30 are, in the region of their forward ends 31, 32 respectively, inclined with respect to the building exterior surface 48 indicated in FIG. 3.

It will further be observed that the inclined interior wall 29 of the bottom member 36 cooperates with the vertical plate 38 to form a trough 49 in which recovered cleaning liquid is collected from a drain tube 50 which communicates at its upper end with the trough 49 and communicates at its lower end with the reservoir 18. A liquid pump 51 draws cleaning liquid from the reservoir 18 through an inlet hose 52 and delivers cleaning liquid under pressure through a delivery hose 53 to a pair of manifold pipes 19 which are supported within the chamber 39 and are disposed generally parallel to each other and generally parallel to the forward edges 31 of the top member 34 and the bottom member 36. A plurality of suitable nozzles 20 is connected to each of the liquid manifolds 19. The spray patterns established by each of the nozzles 20 may be any suitable spray pattern found to be effective for the particular building exterior wall under consideration.

Referring to FIG. 3 the nozzles 20 direct a stream of the cleaning liquid outwardly through the sight against the exterior building wall surface 48. A suitable motor 54 is mounted along with the liquid pump 51 to a bracket 55 secured to a vertical member 24 of the chassis 16. A drain output 56 is provided at the base of the reservoir 18 to permit drainage of the liquid contents when desired.

A motor 57 has its rotable drive shaft 58 connected to the impeller (not shown) of the centrifugal fan 42 and is mounted to the chassis 16 on a suitable bracket 44. The centrifugal fan 42 has its axis of rotation about the shaft 58 inclined with respect to the generally vertical plane of the perimeter aperture 33. The in-line air removal conduit 40 thus allows liquid condensate to return to the chamber 39 by gravity. The inclination of the axis of rotation also permits minimizing the length of the air delivery conduit 46.

BRUSHES

The preferred scrubbing means for the present mobile cleaning device comprises a pair of reciprocatory oscillating brushes 21. Each of the brushes 21 comprises a channel 61 filled with bristles 62. (See FIGS. 3, 4). The two channels 61 are connected by means of pins 63 to idler side links 64 and to a driving center link 65. The driving center link 65 is centrally mounted to a shaft 66 confined within rigidly supported bearings 67 and connected in turn to a drive unit including a toggle arm 68 which is secured at the opposite end of the drive shaft 66, a connecting rod 69 which is pivotally connected to a pin 70 in the toggle arm 68 and also connected to a rotary drive disk 71 at an eccentrically mounted pin 72. A motor 73 is connected to a suitable gear reduction unit 74 to provide the desired rotating velocity of the output shaft 75 to which the rotary drive disk 71 is fastened. Thus it will be apparent that as the outward shaft 75 rotates unidirectionally, the center drive link 65 is caused to oscillate through an arc. This motion is translated through the connecting pin 63 to the channel 61 of the brushes 21 whereby they move from side to side in opposite directions. It will be observed from inspection of FIG. 3 that the brushes 62 extend forwardly beyond the sight defined by the forward edges 31 and actually engage the building exterior wall surface 48 to accomplish scrubbing of the surface. As a result of the disposition of the nozzles 20 above and below the brushes 21, the surface 48 is wetted before the brushes come into contact with the building surface 48 regardless of whether the mobile cleaning device is ascending or descending. Thus the bristles 62 do not engage a dry building surface which might cause objectionable abrasion, but instead contact only well flooded surfaces.

The bearings 67 preferably are rigidly mounted in a suitable bracket 76, see FIGS. 2, 3 which is adequate to support the drive shaft 66 and to support the weight and stresses of the brush assembly in a cantilever fashion. It will be observed in FIG. 2 that the bracket 76 also provides for the rotatable support of mounting shafts 77 which extend through the centers of the side idler links 64.

TRACKING AND MOVEMENT

The present mobile cleaning unit is equipped with building engaging elements serving as spacing means for maintaining the housing 59 in spaced-apart relation from the exterior wall 48. The spacing means is illustrated as upper wheels 22 and lower wheels 23. It is intended that these wheels 22, 23 will engage tracks which may be the vertical mullions 13 of the building 10. Alternatively the tracks may constitute uninterrupted linear elements associated with the vertical mullions 13. In the preferred embodiment the wheels 22, 23 serve multiple purposes, i.e., (a) to maintain the space between the perimeter aperture and the window wall surface more or less constant so that the egress of cleaning liquids through this space can be retarded as a result of the high velocity air current directed against the window wall surface 48 through the perimeter aperture 33; (b) to maintain the present mobile cleaning device 15 in a frictional engagement with tracking elements associated with the vertical mullions 13; (c) to resist lateral thrusts due to wind loadings and seismic loadings; and (d) to resist the moment of the weight of the wall washing unit. It is not intended that the wheels 22, 23 will serve as drive wheels. In the preferred embodiment, the present mobile cleaning device will be raised and lowered over a building exterior wall surface by means of tensioned cables which may be connected to the device through the apertured lug 60 or preferably will be hidden from view within recesses in the vertical mullions 13. Suitable driving connections of the cable variety are described in U.S. Pat. Nos. 3,292,193; 3,298,052; 3,344,454; 3,497,902, supra.

Electrical power for driving the motors 57, 54, 73 is provided through the cable 78, FIG. 2.

The present mobile cleaning device may be moved by self contained drive elements. Such self contained drive units have been described in U.S. Pat. No. 3,425,082, supra. A self contained driving unit is not preferred because of the added weight which the driving elements introduce into the mobile cleaning device.

Figure 4:
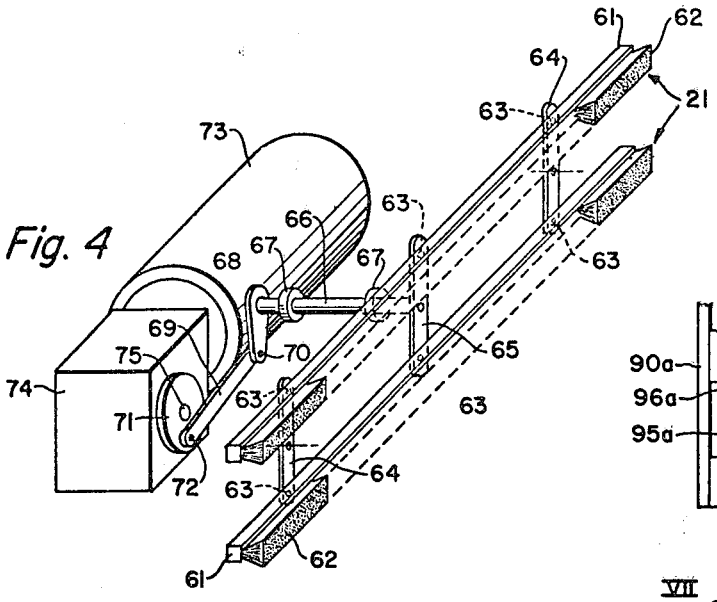
FIG. 4 is an isometric illustration showing a preferred embodiment of the oscillating brush devices.
Figure 5:
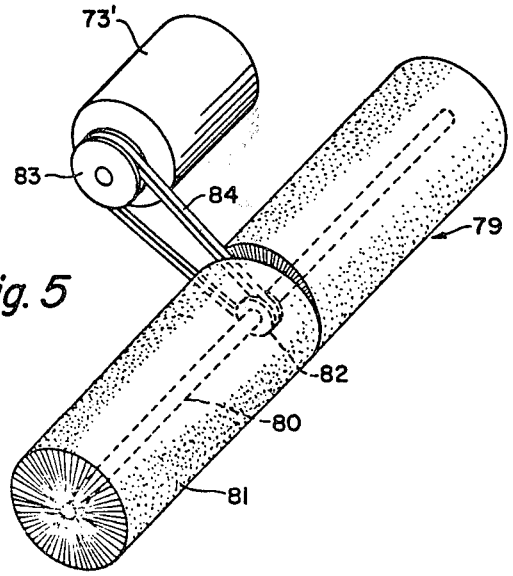
FIG. 5 is an isometric illustration showing an alternative embodiment of a rotary brush as a scrubbing means.

As an alternative embodiment in place of the oscillating brushes of FIG. 4, it is feasible to employ a unidirectional rotating cylindrical brush as shown in FIG. 5. The cylindrical brush 79 includes a central shaft 80 from which bristles 81 radiate. A centrally mounted drive pulley 82 is connected to the shaft 80. A drive motor 73' has a drive pulley 83 connected by means of a drive belt 84 to the drive pulley 82. Suitable deflectors (not shown) are provided to prevent the bristles 81 from interfering with the movement of the drive belt 84 in the manner described in U.S. Pat. No. 3,292,193, supra.

The embodiment illustrated in FIG. 5 is similar to that illustrated in FIG. 4 in that the bristles 81 project forwardly beyond the sight of the hollow perimeter frame into engagement with the building exterior wall surface 48. The cylindrical brush 79, if employed, is mounted between the two liquid manifold pipes 19 so that the sprays 20 are directed above and below the region of agitation resulting from the cylindrical brush 79.

If desired, a moisture removing device such as a demister 85 (FIG. 3) may be mounted within the air removal conduit 40 to reduce the quantity of entrained liquid carried forwardly into the vortex of the centrifugal fan 42.

Suitable filter devices (not shown) will be optional in the cleaning liquid recovery system and may be provided within the housing of the reservoir 18 for removing solids from the recirculating cleaning liquid. The recirculating cleaning liquid of course may be water along or with suitable additives such as detergents, buffers and the like.

The air curtain not only serves to retard the egress of cleaning liquid from the space between the cleaning device and the building exterior wall but it also serves to dry the building exterior wall in the wake of the mobile cleaning device regardless of whether the unit is ascending or descending.

Because the sight is spaced-apart from the window wall, the horizontal muntins 14 do not create obstructions to the continuing movement of the cleaning device 15. With many of the mobile cleaning units of the prior art, wall engaging squeegees or sponges required abnormal depression in order to pass over protruding horizontal muntins. Frequently the force required to accomplish the necessary squeegee depression could not be generated and manual recovery of the mobile cleaning unit was required. The sponges or brushes of the present wall washing device are thick enough, i.e., have sufficient bristle length or sponge thickness, to be pliant and thereby to accommodate wall protrusions without interference.

OPERATION

The perimeter aperture 33 has a thickness of 0.080 to 0.125 inch and develops a corresponding linear velocity of air of 244 to 156 feet per second. The pressure within the chamber 39 can be maintained at minus 1.00 to minus 1.25 inches of water (relative to atmospheric pressure) by means of the suction created by the withdrawal of recirculating air through the air conduit 40.

The liquid spray system preferably operates with a strainer having a retention for 100 mesh particles and a following filter having a retention of particles greater than 50 microns. Flat fan pattern nozzles are preferred having an equivalent orifice of 0.026 inches. The operating pressure preferably is about 150 psi.

The oscillating brush (FIG. 4) drive motor 73 generates a stroke varying from side to side from 2 to 3 inches. The brushes preferably have nylon bristles with bristle diameters of 0.008 inch.

The air knives or air curtains generated by the flow of high velocity air through the perimeter aperture 33 preferably is directed to converge at an inclination angle 86 from about 5° to about 20° and preferably about 15° with respect to the normal 87 (FIG. 3). A predetermined space between the forward edges 31 and the exterior surface of the building 48 is about three-fourths inch.

MOUNTING SYSTEMS

Figure 7:
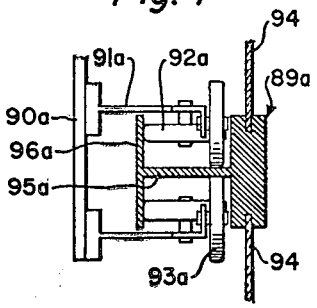
FIG. 7 is a sectional view taken along the line VII—VII of FIG. 6 showing one embodiment of a mounting wheel system.
Figure 6:
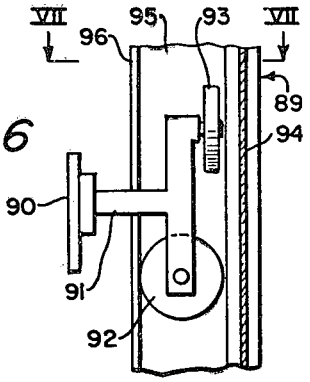
FIG. 6 is a fragmentary sectional view taken along the line VI—VI of FIG. 1 along the center line of a typical vertical mullion illustrating one mounting means.
Figure 8:
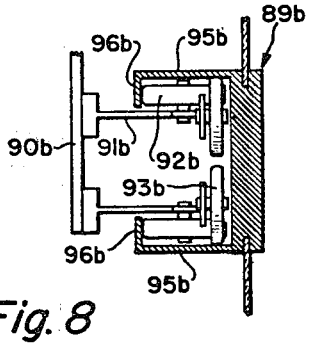
FIG. 8 is a sectional view similar to FIG. 7 showing an alternative embodiment of a mounting wheel system.

Typical mounting arrangements for the present wall washing unit are illustrated in FIGS. 6, 7, 8. In FIG. 6 there is illustrated a vertical mullion 89 and the frame 90 of the wall washing unit from which projects a wall mounting bracket 91 having first wheels 92 and second wheels 93. The vertical mullion 89 which includes web members 95 and flange members 96, may have a T-shaped profile as shown by the mullion **89*a* of FIG. 7 or may have a C-shaped profile as shown by the mullion 89*b* of FIG. 8. Glazing or infill panels 94 connect with the vertical mullions 89.**

In FIG. 7, a web **95*a* of the mullion 89*a* joins flanges 96*a* to produce the T-shaped profile. A unit frame 90*a* has a pair of wheel mounting brackets 91*a* which secure first wheels 92*a* and second wheels 93*a*. The second wheels 93*a* rotate in a plane which is generally parallel to the flanges 96*a* and peripherally engage the web 95*a*. The first wheels 92*a* rotate in a plane which is generally parallel to the web 95*a* and peripherally engage either the inner surface of the flanges 96*a* or the outer surface of the mullion 89*a*. The diameter of the first wheels 92*a* is only slightly less than the space between the mullion 89*a* and the inner face of the flanges 96**a.

In FIG. 8, a vertical mullion **89*b* has a C-shaped profile resulting from parallel webs 95*b* which terminate in inwardly directed flanges 96*b*. The wall washing unit frame 90*b* has a pair of wheel mounting brackets 91*b* on which are mounted first wheels 92*b* and second wheels 93*b*. The second wheels 93*b* rotate in the planes which are parallel to the flanges 96*b* and are peripherally engaged with the inner surfaces of the webs 95*b*. The first wheels 92*b* rotate in planes which are parallel to the webs 95*b* and peripherally engage either the inner surfaces of the flanges 96*b* or the outer surfaces of the mullions 89*b*. The diameter of the first wheels 92*b* is slightly less than the space between the outer surface of the mullion 89*b* and the inner surface of the flanges 96*b*.**

It will be observed that the mounting means of FIGS. 6, 7, 8 restrict movement of the wall washing unit from side-to-side and movement toward-and-away from the mullions 89. The wall washing unit at the top of the building is pulled upwardly apart from the tops of the mullions 89 and transported laterally to a different set of vertical mullions for the similar connection. At the bottom of the building, the wall washing unit may be pulled downwardly apart from the pair of vertical mullions 89 and moved laterally to engage a different set of vertical mullions in the same manner.

An alternative embodiment of the present mobile cleaning device is illustrated in FIGS. 9 through 17 inclusive and is identified generally by the numeral 100. Corresponding numerals will be employed to identify corresponding parts heretofore described.

Figure 9:
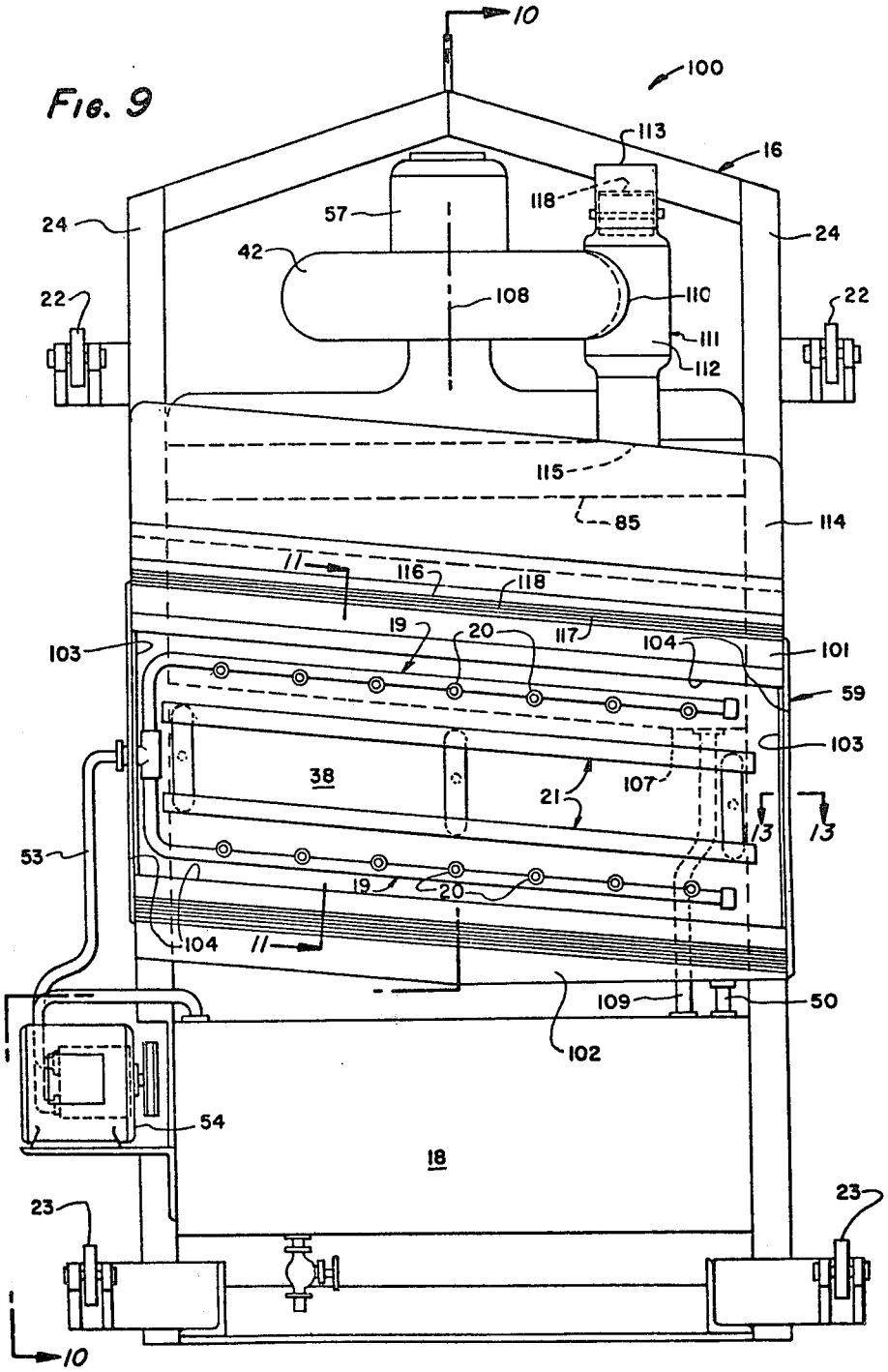
FIG. 9 is a front elevation illustrating an alternative embodiment of the present mobile cleaning device as viewed from the building exterior wall surface.
Figure 10:
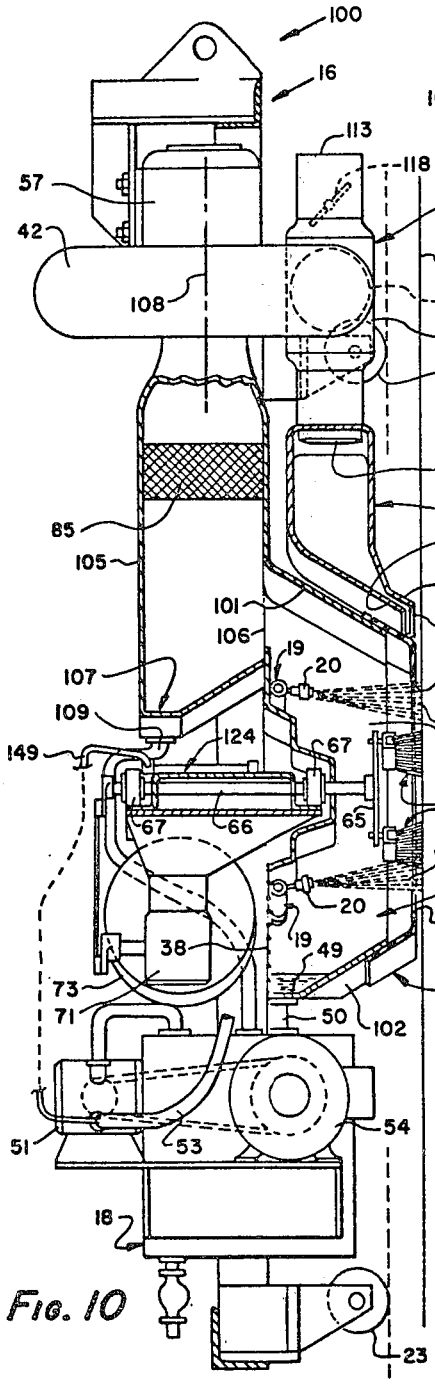
FIG. 10 is a cross-sectional view taken along the line 10—10 of FIG. 9, illustrating the mobile cleaning device in operating relation to a building exterior wall surface.

According to FIGS. 9 and 10, the mobile cleaning device 100 includes a housing 59 supported by and extending forwardly of the vertical frame elements 24 of the chassis 16. The housing 59 is defined by upper and lower inclined boundary walls 101, 102, side boundary walls 103 and a rear wall 38. The boundary walls 101, 102, 103 and the rear wall 38 defined a chamber 39. It will be observed in FIG. 9 that the housing 59 presents forward edges 104 forming an enclosed rectangle which defines the sight of active washing accomplished by the present mobile cleaning device 100. It will be observed in FIG. 10 that the nozzles 20 of the liquid manifolds 19 direct liquid sprays 154 through the sight against the building exterior surface 48; and that the oscillating brushes 21 extend through the sight into engagement with the building exterior surface 48. The recovered cleaning liquid accumulates in the trough 49 and is returned to the reservoir 18 through the drain tube 50.

It will be observed in FIG. 10 that a vertically presented air removal conduit 105 communicates with the chamber 39 through an opening 106. The upper end of the air removal conduit 105 communicates with the inlet of fan means which preferably comprises a centrifugal fan 42 driven by a motor 57. The fan 42 has an axis of rotation 108 which is vertically presented and parallel with the generally vertical plane of the sight. An entrained liquids removing device such as a demister 85 is mounted within the air removal conduit 105 above the opening 106. The air removal conduit 105 has a trough-shaped bottom 107 for accumulating liquids removed by the demister 85. The recovered liquids are returned to the reservoir 18 through a second drain tube 109.

The centrifugal fan 42 presents a discharge opening 110 communicating with second conduit means 111. It will be observed in FIGS. 9 and 10 that the second conduit means 111 comprises a conduit segment 112 having an upper outlet opening 113 communicating with the atmosphere for discharging gases extracted from the chamber 39. If desired, the mobile cleaning device 100 may be provided with a duct 114 extending across the top of the housing 59 and communicating with the conduit segment 112 through a lower outlet opening 115. The duct 114 presents an upper forward edge 116 and a lower forward edge 117. The space between the forward edges 116, 117 provide second aperture means 118 positioned outboard of the sight for delivering a supplementary curtain of high velocity, drying gas at a suitable inclination angle against the building exterior surface 48, as will be described. Proportioning valve means 119 may be provided within the second conduit means 111 preferably above the fan discharge opening 110, for controlling the volume of extracted gas delivered to the second aperture means 118.

Figure 11:
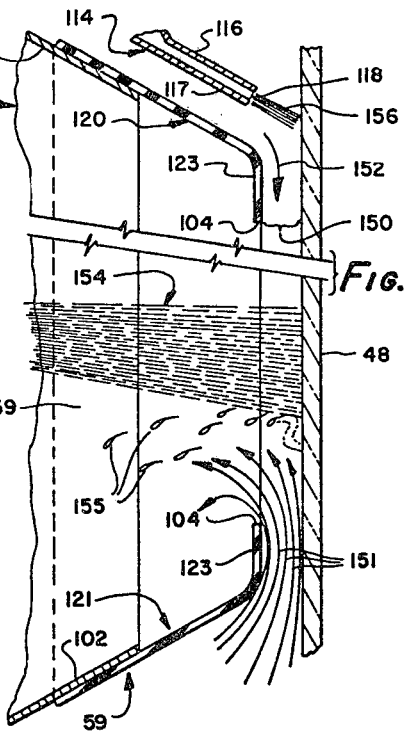
FIG. 11 is a fragmentary, broken, cross-sectional view taken along the line 11—11 of FIG. 9, illustrating upper and lower edge members of a housing, and the action of a high velocity, in-rushing air curtain on the washing liquids.
Figure 12:
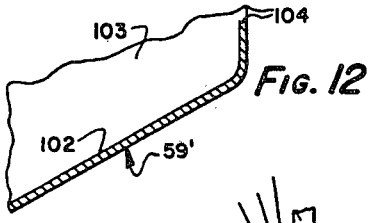
FIG. 12 is a fragmentary cross-sectional view illustrating an alternative housing edge member.
Figure 13:
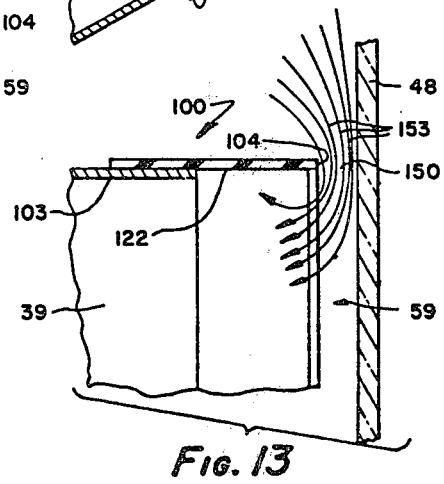
FIG. 13 is a fragmentary cross-sectional view taken along the line 13—13 of FIG. 9, illustrating an edge member of a housing.

It will be observed in FIGS. 11 and 13, that the housing 59 is provided with flexible forward portions in the form of upper and lower resilient rails 120, 121 (FIG. 11) secured to the upper and lower walls 101, 102, respectively; and resilient side rails 122 (FIG. 13) secured to the side walls 103 of the housing 59. It will be observed in FIG. 11 that the upper and lower rails 120, 121 include inturned flanges 123 presenting the forward edges 104. Alternatively, the housing 59' (FIG. 12) may present rigid forward portions constituting extensions of the walls of the housing 59'.

Figure 14:
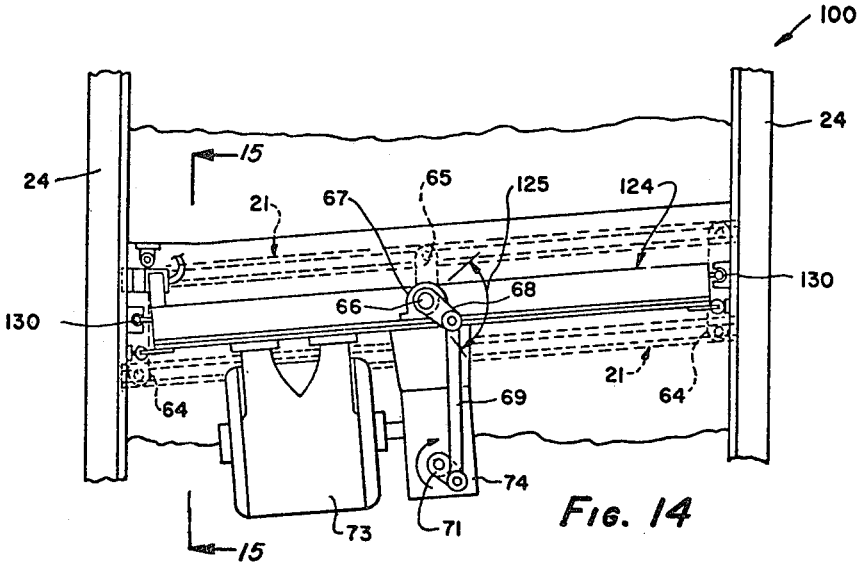
FIG. 14 is a fragmentary rear view of the mobile cleaning device of FIG. 9, illustrating a movable carriage supporting a mechanism for oscillating brush devices.
Figure 15:
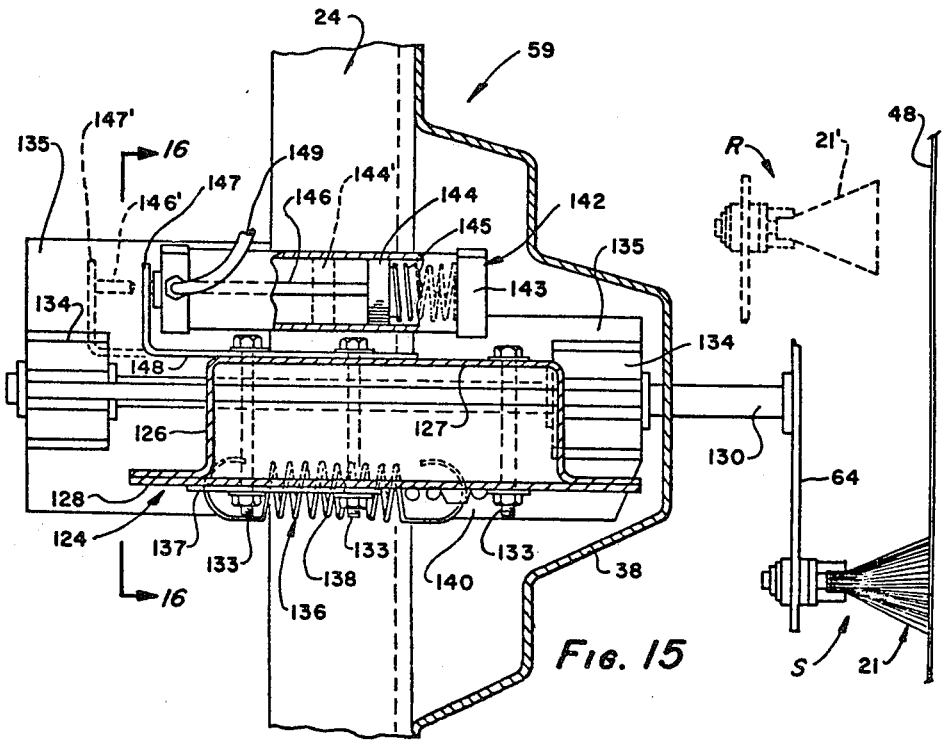
FIG. 15 is a cross-sectional view taken along the line 15—15, further illustrating the movable carriage of FIG. 14.

Referring to FIGS. 10, 14 and 15, the mobile cleaning device 100 is provided with platform means 124 for supporting the mechanical scrubbing elements (brushes 21) for reciprocal movement through the sight between a scrubbing position S (FIGS. 10 and 15) and a retracted position R — see dotted outline position in FIG. 15 — wherein the brushes 21 are spaced from the scrubbing position S and the building exterior surface 48. It will be observed in FIGS. 10 and 14 that the drive motor 73 and gear reduction unit 74 are secured to and movable with the platform means 124. As best shown in FIG. 10, the drive shaft 66 connected to the driving center link 65, is confined within the support bearings 67 which, in turn, are secured to the opposite sides of the platform means 124. The driving connection between the drive shaft 66 and the gear reduction unit 74 is similar to that drive connection illustrated in FIG. 4 and includes the toggle arm 68, the rotary drive disc or arm 71, and the connecting rod 69. The driving connection of FIG. 14 is such that as the rotary drive arm 71 rotates unidirectionally, the center drive link 65 is caused to oscillate through an arc indicated at 125, whereby the brushes 21 are moved from side to side in opposite directions.

Figures 16, 17:
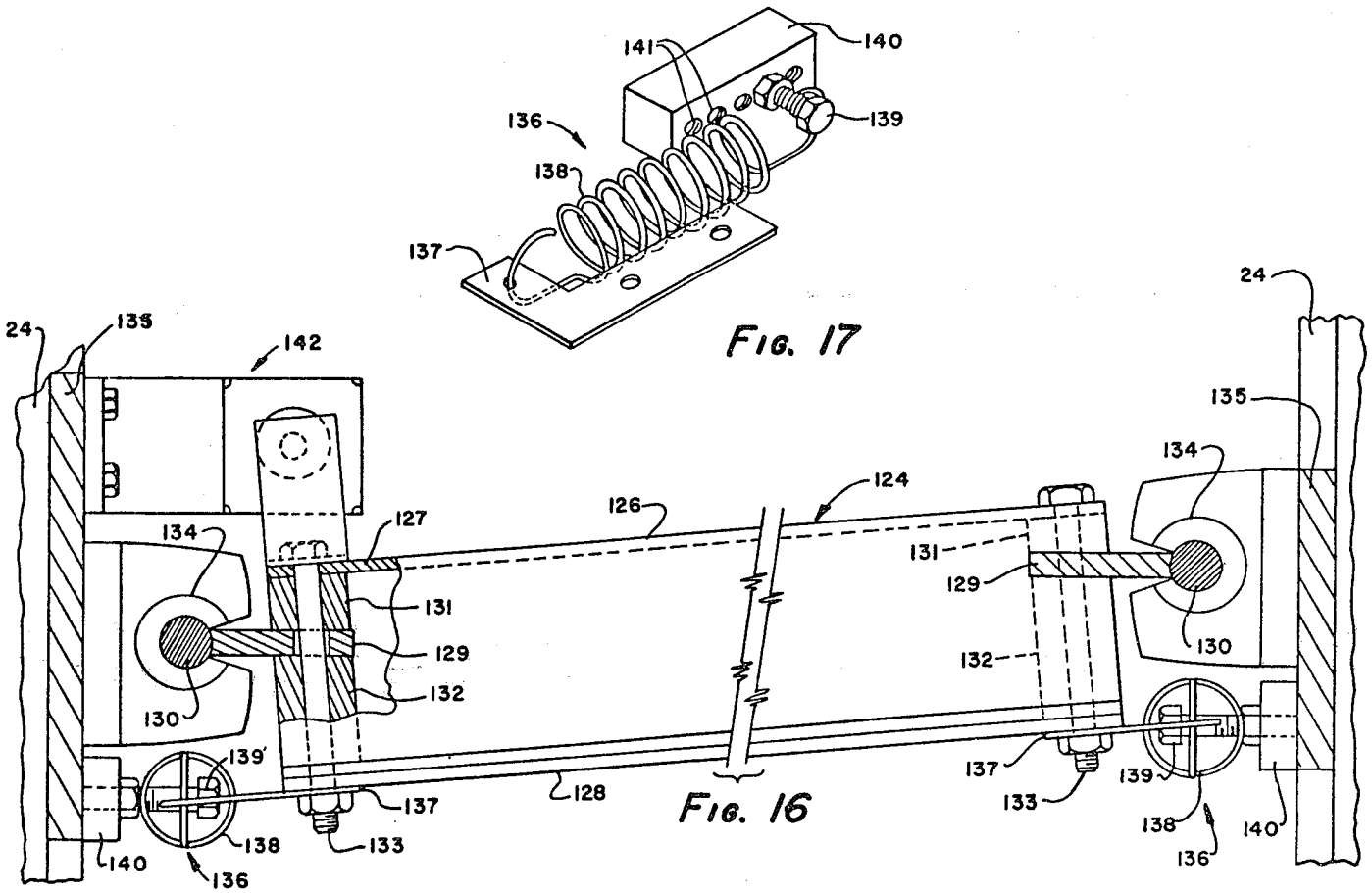
FIG. 16 is a broken, fragmentary cross-sectional view taken along the line 16—16 of FIG. 15, illustrating linear brushings supporting the movable carriage.
FIG. 17 is an isometric view of a typical, adjustable spring arrangement for urging the movable carriage toward the building exterior wall surface.

It will be observed in FIGS. 15 and 16 that the platform means 124 may be assembled from a hat-shaped upper sheet 126 presenting a top wall 127 and a flat lower sheet 128. As best shown in FIG. 16, each of the opposite ends of the platform means 124 is supported by a horizontal plate 129 having one of its longitudinal edges secured to a shaft 130 and its opposite longitudinal side portion disposed between upper and lower clamp blocks 131, 132. The clamp blocks 131, 132 are disposed between the confronting faces of the top wall 127 and the flat lower sheet 128. The block 131, 132 and the plate 129 are rigidly secured to the platform means 124 by plural fasteners 133 (FIG. 15).

It will be observed in FIGS. 15 and 16 that each of the shafts 130 is supported for longitudinal reciprocation by a pair of journal means, such as linear bushings 134. The linear bushings 134 are secured to support plates 135 attached to the vertical frame elements 24. Each of the shafts 130 has an end projecting through the rear wall 38 of the housing 59 and supporting one of the idler side links 64.

A platform means 124 is provided with resilient means 136 for urging the mechanical scrubbing elements (brushes 21) through the sight into the scrubbing position S (FIG. 15). Referring to FIGS. 16 and 17, the resilient means 136 may comprise an arm 137 secured to the platform means 124 by means of the fasteners 133. A block 140 having spaced-apart threaded openings 141 is secured to the vertical frame member 24. A bolt 139 is introduced into a selected one of the threaded openings 141. A spring 138 has one of its ends hooked over the bolt 139 and its opposite end connected to the arm 137. The tension provided by the spring 138 may be adjusted by introducing the bolt 139 into another one of the threaded openings 141. It will be observed in FIG. 15 that the block 140 is positioned between the arm 137 and the brushes 21. Thus, the spring 139 urges the platform means 124 toward the building exterior surface 48.

The platform means 124 also is provided with motor means 142 (FIGS. 15 and 16) for moving the mechanical scrubbing elements 21 to the retracted position R (FIG. 15). It will be observed in FIG. 15 that the motor means 142 may comprise a fluid operated cylinder 143 having a piston 144 biased in a direction away from the building exterior surface 48 by a spring 145. A piston rod projects from the cylinder 143 into engagement with an upstanding arm 147 of an angle member 148. The angle member 148 is secured to the top wall 127 of the platform means 124 by the fasteners 133. The cylinder 143 includes an inlet hose 149 for introducing fluids under pressure to displace the piston 144 in the direction which compresses the spring 145. With the spring 145 in the compressed condition illustrated in FIG. 15, the resilient means 136 contracts and urges the mechanical scrubbing elements 21 into engagement with the building exterior surface 48.

In the preferred arrangement (FIG. 10) the opposite end of the inlet hose 149 communicates with the delivery hose 53 — the delivery hose 53 being connected to the liquid manifolds 19 (FIG. 9). Thus, when the liquid pump 51 is activated, liquid under pressure is communicated to the manifolds 19 while simultaneously being communicated to the motor means 142. Hence, the mechanical scrubbing elements 21 are urged into engagement with the building exterior surface 48 as the nozzles 20 direct the liquid sprays 154 against the building exterior surface 48. Thus it can be stated that the motor means 142 is responsive to reduced liquid pressures in the liquid distributing means (manifolds 19). At the termination of a washing cycle, the liquid pump 51 is deactivated whereby the liquid pressure within the delivery hose 53 and the inlet hose 149 is reduced. At that time, the piston and piston rod will be moved to the dotted outline positions 144', 146' (FIG. 15) under the influence of the spring 145 — the upstanding arm likewise being displaced to the 147' position thereby retracting the platform means 142 and the brushes to the retracted position R.

OPERATIONS

Referring to FIGS. 11 and 13, the forward edges 104 of the housing 59 are maintained spaced apart from the building exterior surface 48 to provide a gap 150 of approximately one-fourth to three-eighths of an inch. The pressure within the chamber 39 can be maintained at minus 9 to minus 12 inches of water (relative to atmospheric pressure) by means of the suction created by the centrifugal fan 42 (FIG. 10). The suction causes atmospheric air to be forceably drawn into the chamber 39 through the gap 150 as high velocity, in-rushing air curtains illustrated schematically by the arrows 151, 152 (FIG. 11) and 153 (FIG. 13). The suction within the chamber 39 develops a corresponding linear air velocity at the gap 150 of 80 to 100 feet per second.

It will be observed in FIG. 11 that impingement of the liquid spray 154 against the building exterior surface 48 creates liquid drops 155 which, in the absence of the curtain 151, would descend along the surface 48. However, the high velocity in-rushing air curtain 151 precludes the egress of the liquid drops 155 from the wall washing sight and carries them into the chamber 39 to the trough 49 (FIG. 10).

The mobile cleaning device 100 performs its wall washing function during the descending movement over the building exterior surface 48. Suitable transfer apparatus (not illustrated) will be provided at the top of the building to permit the transfer of the mobile cleaning device from one location between a first pair of vertical mullions to a new location between a different pair of vertical mullions.

It will be noted that the curtains 151, 153 between the lower resilient rail 121 and the resilient side rails 122 serve to retard the egress of cleaning liquids from the sight through the gap 150. As the mobile cleaning device 100 descends, the curtain 152 between the upper resilient rail 120 and the building exterior surface 48 serves to dry the building exterior surface 48 in the wake of the mobile cleaning device 100. To assist in drying the building exterior surface 48, the second aperture means 118 (FIG. 11) may be provided to direct a supplementary high velocity air curtain 156 against the building exterior surface 48 in the wake of the mobile cleaning device 100.

A further alternative embodiment of the present mobile cleaning device is illustrated in FIGS. 18 through 30, inclusive, and is identified generally by the number 160. Corresponding numerals will be employed to identify the corresponding parts heretofore described.

Figure 21:
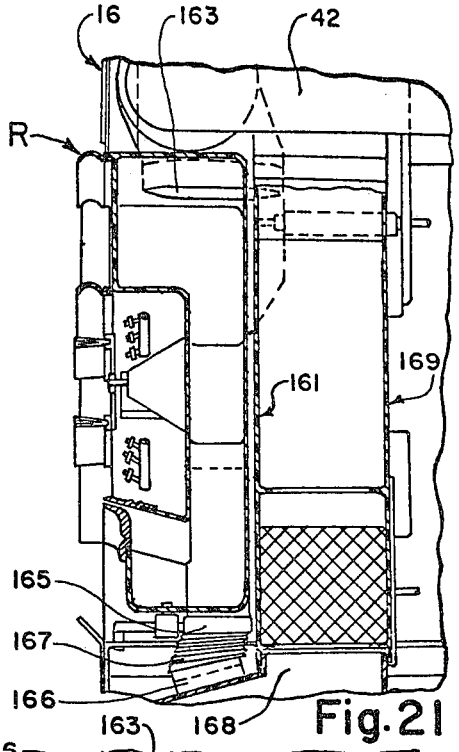
FIG. 21 is a fragmentary cross-sectional view, similar to FIG. 19, illustrating the housing in a retracted position.
Figure 20:
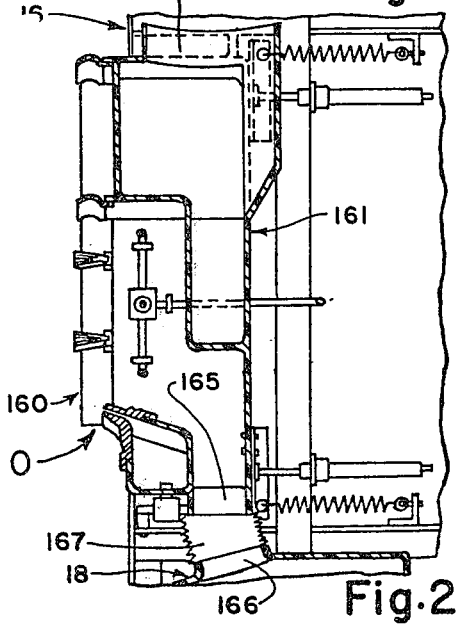
FIG. 20 is a fragmentary cross-sectional view taken along the line 20—20 of FIG. 18.

According to FIGS. 18 through 21, the mobile cleaning device 160 includes a housing 161 supported by a journal means, such as linear bushings 162 carried by the chassis 16, for movement between an operating position O (FIGS. 19 and 20) and a retracted position R (FIG. 21). The housing 161 includes an upper inlet 163 which is connected to the outlet of the centrifugal fan 42 by a flexible conduit 164. The housing 161 additionally includes lower outlets 165, each connected to one of the reservoir inlets 166 by a flexible conduit 167. A hood 169 (FIGS. 18 and 19) has a lower hood end **170*a* communicating with an upper reservoir outlet 168 and an upper hood end 170*b* communicating with the inlet of the centrifugal fan 42. An entrained liquids removing device such as a demister 85 is mounted within the lower hood end 170*a* above the upper reservoir outlet 168**.

The housing 161 (FIGS. 23 through 26) includes, as outer wall elements, upper and lower walls 171, 172, opposite side walls 173 and a rear wall 174. Within the confines of the outer wall elements 171 through 174, there is presented, as inner wall elements, upper and lower walls 175, 177, a rear wall 176, intermediate horizontal walls 185, and intermediate side walls 186. The housing 161 also includes a lower front wall 178 adjoining the outer lower wall 172, and an upper front wall 179 extending between the outer and inner upper walls 171, 177 and between the outer side walls 173. The upper front wall 179 is provided with plural air discharge openings 180.

It will be noted that the inner walls 175, 176, 177, the opposite outer walls 173, and the blade member 188 comprise boundary walls which define the chamber 39. The chamber 39 presents a forward edge 191 forming an enclosed rectangle which defines the site of active wall washing accomplished by the present mobile cleaning device 161.

Figure 25:
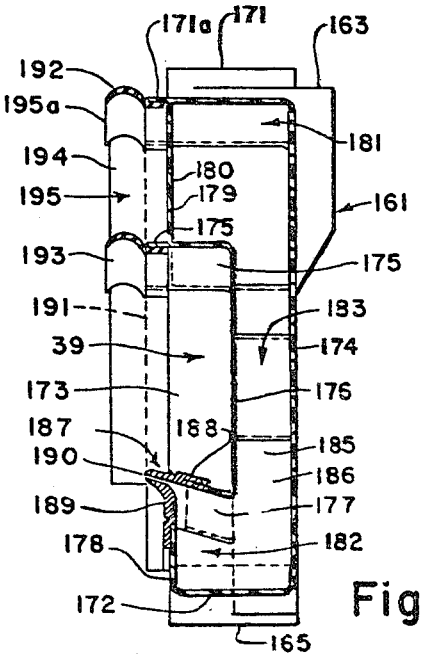
FIG. 25 is a cross-sectional view taken along the line 25—25 of FIG. 23.
Figure 26:
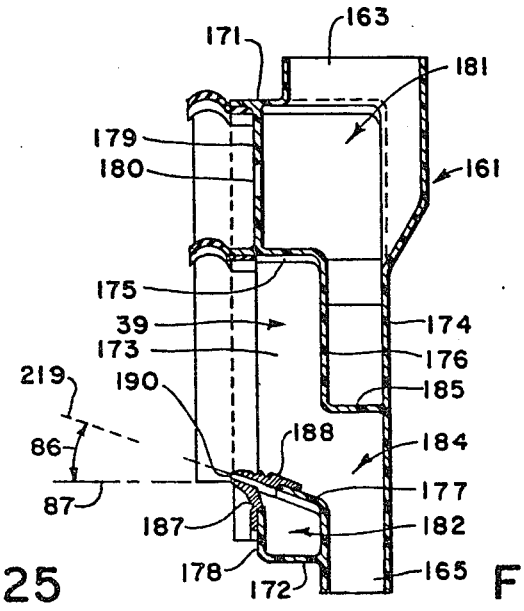
FIG. 26 is a cross-sectional view taken along the line 26—26 of FIG. 23.

It will be observed in FIGS. 25 and 26 that the various wall elements cooperate to provide an upper air distributing duct 181 communicating with the air inlet 163, a lower air distributing duct 182, a vertically presented air duct 183 (FIG. 25) providing communication between the upper and lower air distributing ducts 181, 186, and lateral passageways 184 (FIGS. 23, 26) disposed on opposite sides of the vertical air duct 183, providing communication between the chamber 39 and the housing outlets 165.

Means disposed across the bottom of the chamber 39 provides a high velocity in-rushing gas curtain 219 (see FIG. 27) to preclude substantial egress of liquid between the bottom forward edge of the chamber 39 and the building exterior wall. That means comprises, in part, an air knife assembly 187 (FIGS. 23, 25 and 26) provided at the exit of the lower air distributing chamber 182. The air knife assembly 187 comprises blade members 188, 189 secured, respectively, to the inner lower wall 177 and to the lower front wall 178. The outer ends of the blade members 188, 189 are spaced-apart and provide a linear aperture 190 extending entirely across the front of the mobile cleaning device 161, i.e., between the opposite outer walls 173, see FIG. 18.

As will be described, the lower air distributing duct 182 receives pressurized air and releases that pressurized air through the aperture 190 as a high velocity air curtain represented by the dashed line 219 in FIG. 26. The air curtain is directed upwardly into the site at an inclination angle 86 (FIG. 26) from about 5° to about 20° and preferably about 15° with respect to the normal represented by the dash-dot line 87.

It will be observed in FIG. 25 that the upper walls 171, 175 present forward wall portions **171*a***, 175*a*, respectively, extending forwardly of the upper front wall 179. First and second flexible means, such as squeegee elements 193, 192 and secured to the forward wall portions **175*a***, 171*a*, respectively, and are thereby maintained in spaced-apart generally parallel relation. The squeegee elements 192, 193 extend forwardly of the housing forward edge 191.

The housing 161 also is provided with resilient side rails 194, one secured to each of the opposite outer side walls 173. Each of the resilient side rails 194 is vertically presented and extends between the corresponding ends of the squeegee elements 192, 193 and downwardly therefrom adjacent to the aperture 190. It will be observed in FIG. 25 that the squeegee 192, 193 extend outwardly beyond the resilient side rail 194.

The housing 161 presents means extending across the top of the chamber 39 for providing at least one high-velocity in-rushing gas stream to assist the squeegee 192, 193 in removing excess cleaning liquids from protrusions, such as the horizontal muntin 14 (FIGS. 27, 28) in the building exterior wall. That means is provided, in part, by a compartment 195 defined by the squeegee elements 192, 193, those portions of the resilient rails 194 presented at the corresponding ends of the squeegee elements 192, 193, and the upper front wall 179. The compartment 195 presents a mouth 195*a* adapted to be capped by the building exterior wall during a washing cycle. As will be described, the upper air distributing duct 181 (FIG. 25) receives pressurized air which is released through the openings 180 into the compartment 195. The pressurized air is released from the compartment 195 as at least one high velocity air stream, as will be described.

Figure 18:
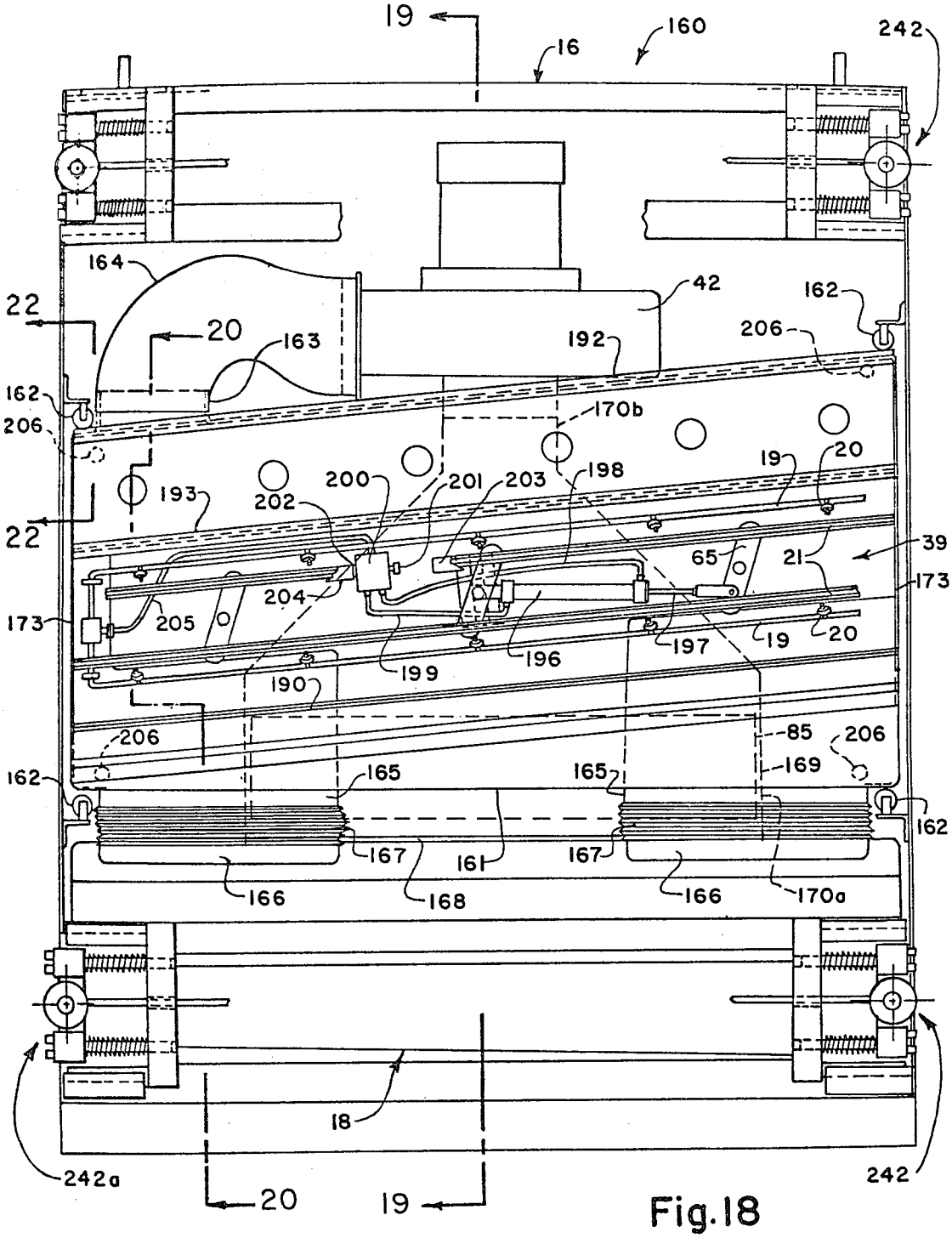
FIG. 18 is a front elevation illustrating a further alternative embodiment of the present mobile cleaning device as viewed from the building exterior wall surface.
Figure 19:
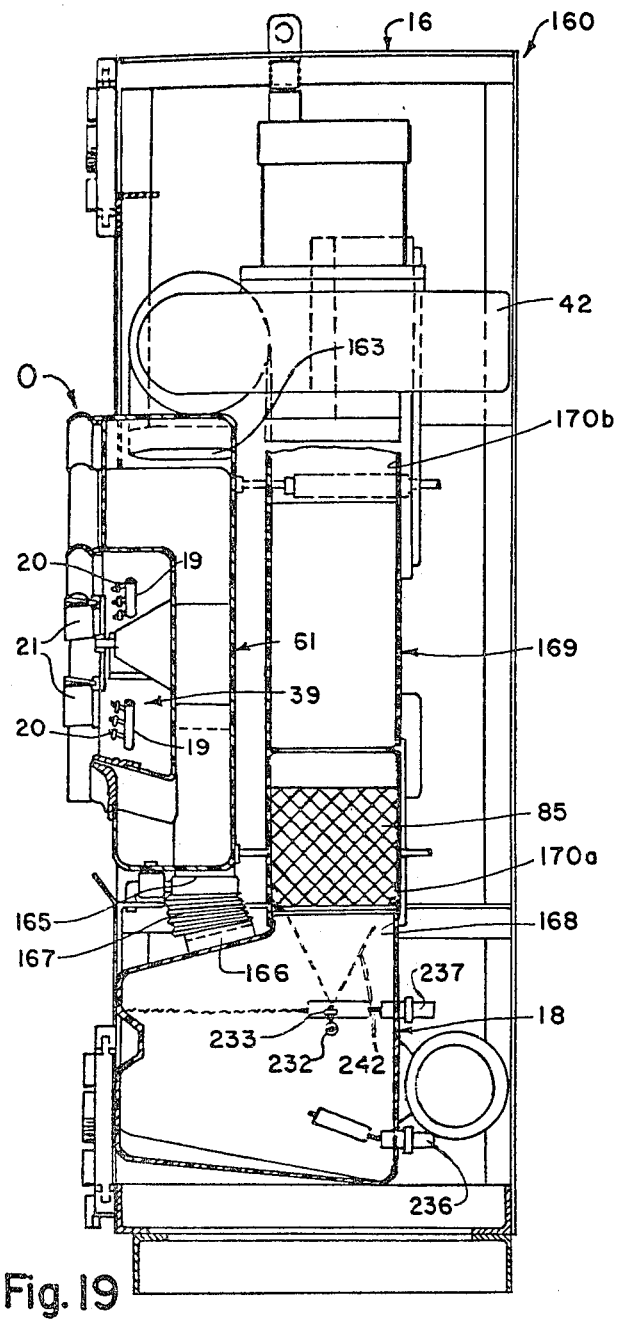
FIG. 19 is a cross-sectional view taken along the line 19—19 of FIG. 18.

It will be observed in FIGS. 18, 19 that the manifolds 19 are supported within the chamber 39 — the nozzles 20 being positioned to direct liquid sprays 154 (FIGS. 27, 28) through the site defined by the forward housing edge 191. The oscillating brushes 21 also are supported within the chamber 39 and extend through the site.

As best shown in FIG. 18, oscillator means, such as double acting, fluid actuated motor means 196, is provided for oscillating the brushes 21 during the wall washing cycle. The motor means 196 presents a rod 197 pivotally connected to the driving link 65 at a location offset from the pivot point of the driving link 65.

Figures 27, 28, 30:
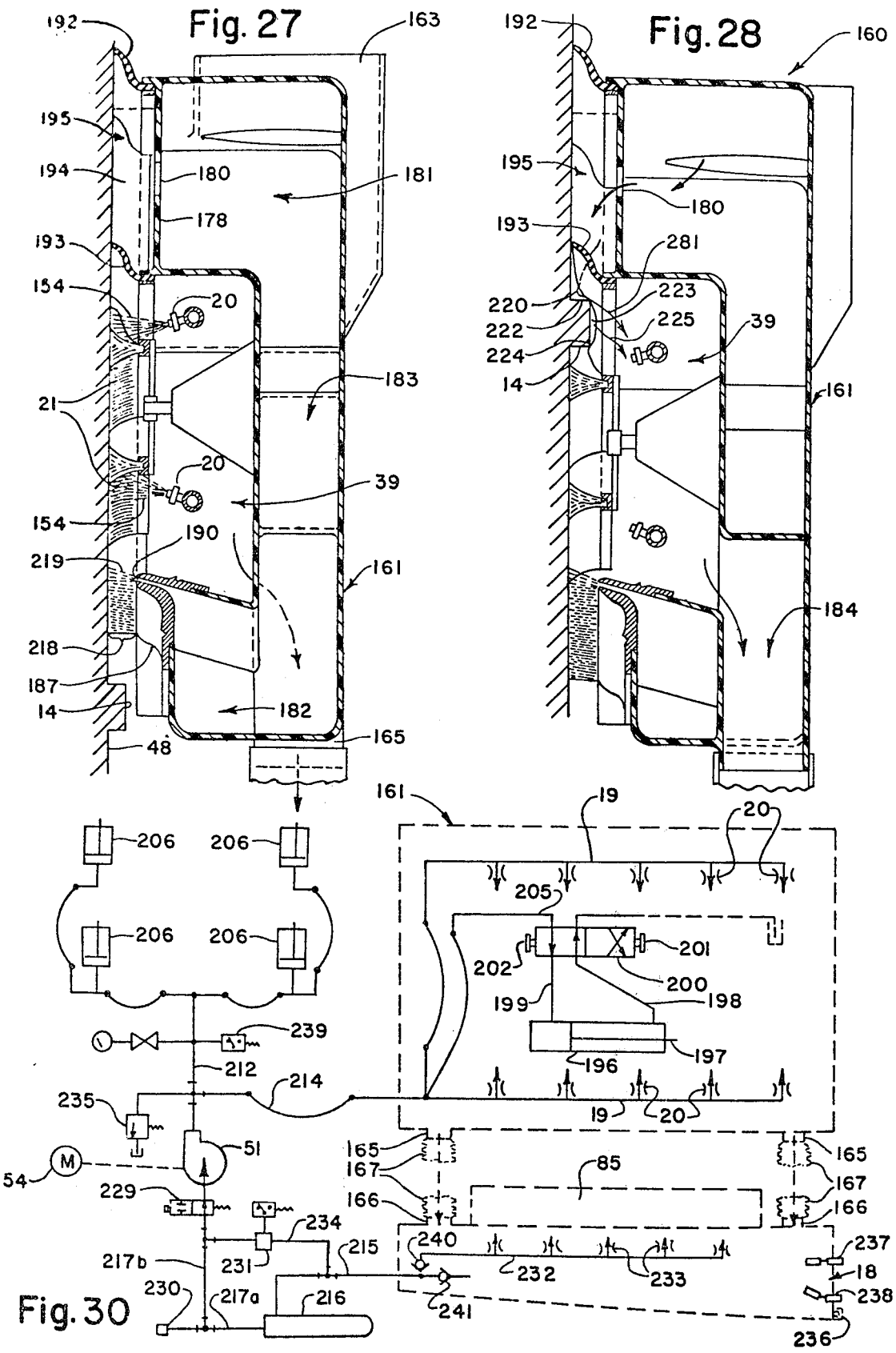
FIG. 27 is a fragmentary cross-sectional view illustrating the housing in operating relation to a building exterior wall surface.
FIG. 28 is a fragmentary cross-sectional view, similar to FIG. 27, illustrating the movement of the present mobile cleaning device over a horizontal outward projection in the building exterior wall surface.
FIG. 30 is a schematic illustration of the hydraulic control circuit for the present mobile cleaning device.

Referring to FIGS. 18, 30, the motor means 196 receives fluid impulses alternately from fluid lines 198, 199 which, in turn, receive fluid impulses from valve means, such as a spool valve 200. The spool valve 200 presents valve operators 201, 202 which are actuated by abutments 203, 204 (FIG. 18) carried by the upper one of the brushes 21. Pressurized fluid is supplied to the spool valve 200 by a fluid supply line 205. In operation, a fluid impulse is conveyed by the fluid line 199 to the motor means 196 causing the piston rod 197 to rotate the driving link 65 in a counter-clockwise direction. When the abutment 203 depresses the valve operator 201, a fluid impulse is conveyed by the fluid line 198 thereby causing the piston rod 197 to retract and rotate the driving link 65 in a clockwise direction. When the abutment 204 depresses the valve operator 202 the cycle is repeated.

Figure 22:
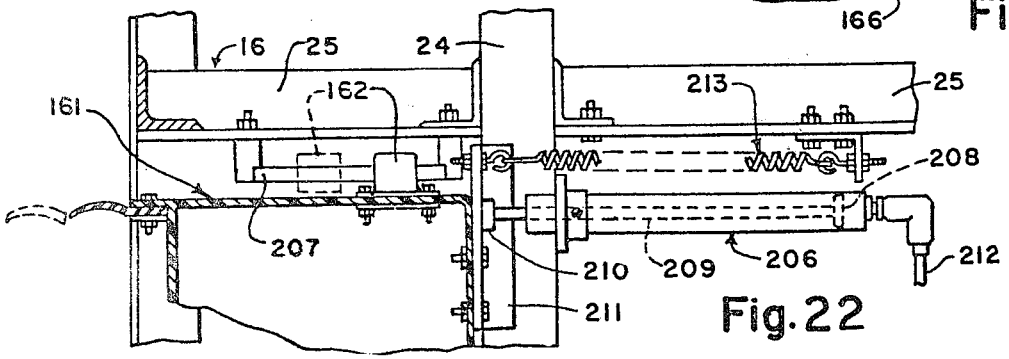
FIG. 22 is a fragmentary cross-sectional view taken along the line 22—22 of FIG. 18, illustrating typical means for supporting and moving the housing between operating and retracted positions.
Figure 24:
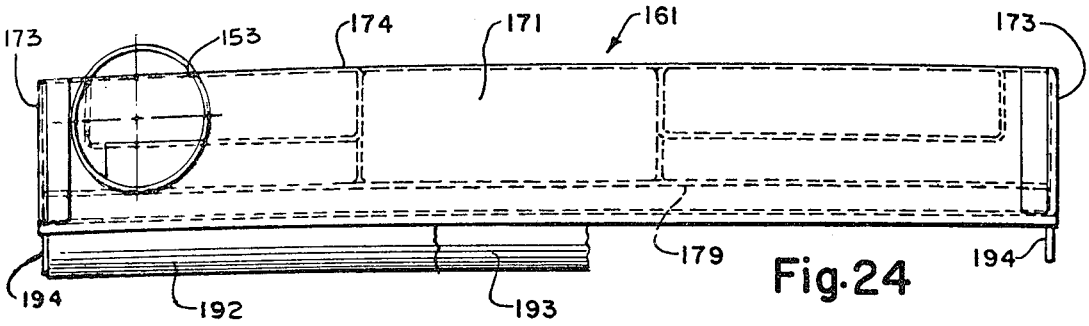
FIG. 24 is a plan view of the housing of FIG. 23.
Figure 23:
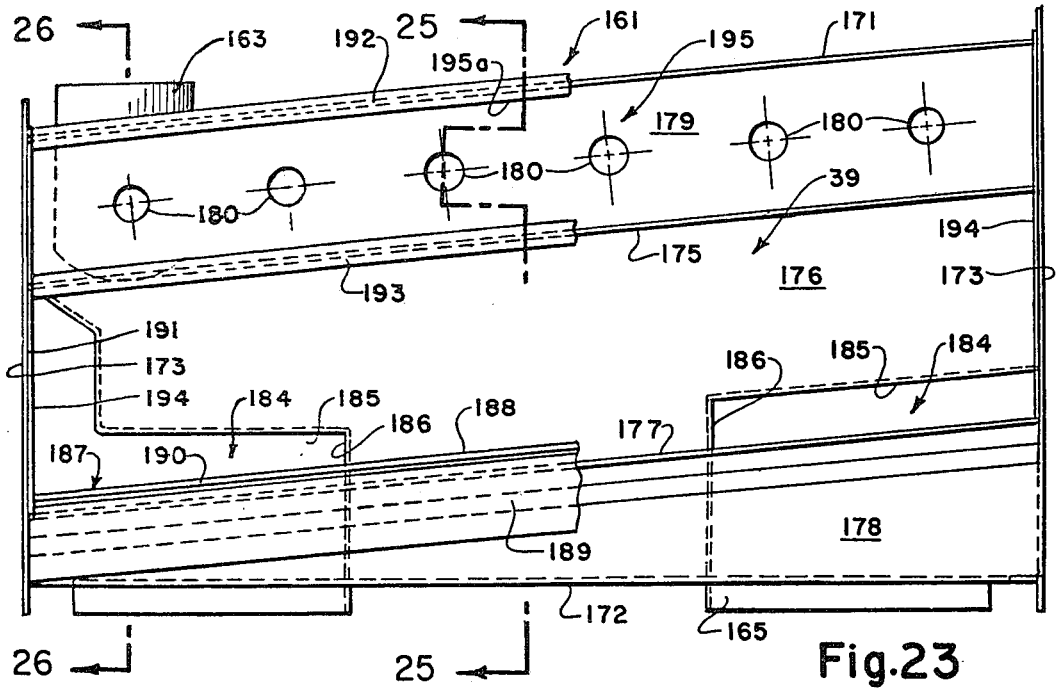
FIG. 23 is a front elevation illustrating the housing employed in the movable cleaning device of FIG. 18, as viewed from the building exterior wall surface.

As described above, the entire housing 161 is supported at its four corners by the linear bushings 162 for movement between the operating position O (FIG. 19) and the retracted position R (FIG. 21). Means, in the form of fluid actuated motor means 206 positioned adjacent to each of the linear bushings 162, is provided for moving the housing 161 between the retracted position R and the operating position O. The typical arrangement of the linear bushings 162 and the motor means 206 is illustrated in FIG. 22. The linear bushing 162 is secured to the housing 161 and is slideable along a guide member 207 between the retracted position illustrated in full lines and the operating position illustrated in dotted lines. The opposite ends of the guide member 207 are secured to the horizontal frame member 25.

It will be observed in FIG. 22 that the motor means 206 includes a piston 208 connected to a piston rod 209. A piston rod end 210 engages a bracket 211 which is secured to the housing 161. The motor means 206 receives pressurized fluids from the fluid line 212. Spring means 213 is provided for urging the housing 161 into the retracted position illustrated in FIG. 22. The spring means 213 has one end connected to the bracket 211 and an opposite end connected to the horizontal frame element 25. It will be observed in FIG. 30 that during the washing cycle, the fluid pump 51 pressurizes the fluid in the supply line 212 whereby the rod ends 210 of the motor means 206 displace the housing 161 into its operating position. At the termination of the washing cycle, the liquid pump 51 is deactivated to reduce the liquid pressure within the delivery conduit 212. At that time, the spring means 213 (FIG. 22) returns the housing 161 to its retracted position R (FIG. 21).

It will be observed in FIG. 30 that the cleaning liquid collected in the chamber 39 is returned to the liquid reservoir 18 through the lower housing outlets 165, the flexible conduit 167 and the reservoir inlets 166. The cleaning liquid is recirculated through the system for reuse by the liquid pump 15 which draws liquid from the reservoir 18 through delivery line 215, a filter 216, and delivery branch lines 217*a*, 217*b*. The filter 216 serves to remove solids from the recirculated cleaning liquid. The mobile cleaning device 160 also is provided with mullion engaging assemblies 242, one disposed at each corner of the chassis 16. The mullion engaging elements of the assembly 242*a* are illustrated in an extended or mullion engaging position whereas the mullion engaging elements of the other assemblies 242 are illustrated in a retracted or disengaged position.

Figure 32:
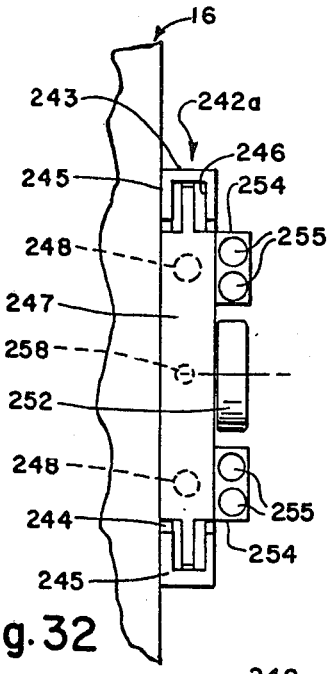
FIG. 32 is a fragmentary side view of the mullion engaging element as seen from the line 32—32 of FIG. 31.
Figure 31:
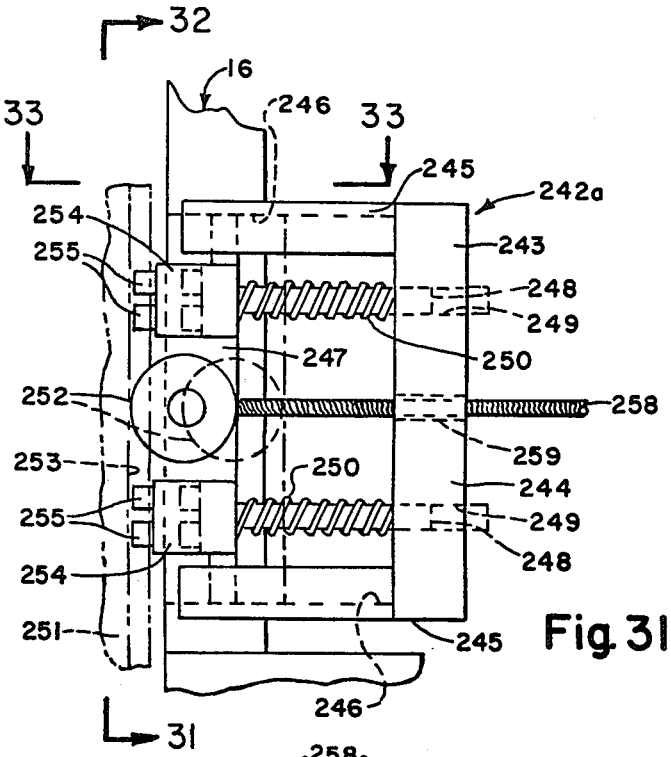
FIG. 31 is a fragmentary front view illustrating a mullion engaging element.
Figure 33:
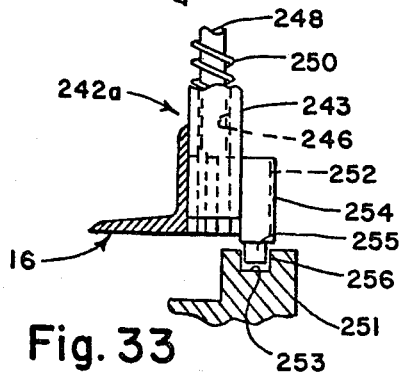
FIG. 33 is a fragmentary top view, partly in cross-section, illustrating the mullion engaging element as seen from the line 33—33 of FIG. 31.

Since the assemblies 242 are identical in construction, the following description of the assembly 242*a* applies to the remaining assemblies 242. Referring to FIGS. 31 to 33, the assembly 242*a* includes a C-frame 243 secured to the chassis 16, and presenting a vertical arm 244 and horizontal arms 245. The arms 245 include lengthwise slots 246 in which a carrier 247 is slideably received. Rods 248 extend rearwardly from the carrier 248 into guide holes 249 (FIG. 31). Spring member 250, one carried by each of the rods 248, urge the carrier 247 outwardly of the chassis 16 toward a mullion 251 (FIG. 33). A wheel 252 is rotatably supported on the carrier 247 and is maintained engaged in a vertically presented mullion groove 253 by the springs 250. The carrier 247 also is provided with blocks 254, one positioned above and one positioned below the wheel 252. A pair of guide rollers 255 is presented by each of the blocks 254. The guide rollers 255 roll vertically along a face 256 of the mullion groove 251 (FIG. 33) and maintain the mobile cleaning devices 160 in operative engagement with the building exterior surface 48, see FIGS. 27, 28.

Figure 34:
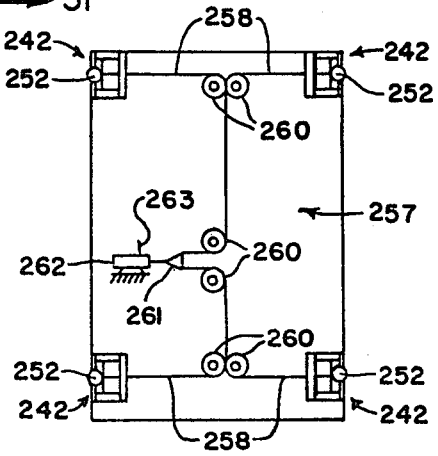
FIG. 34 is a schematic illustration of means for retracting the mullion engaging elements.

The mobile cleaning device 160 also is provided with retracting means 257 (FIG. 34) for retracting the carriers 247 and thereby disengaging the wheels 252 from the mullions 251. The retracting means 257 may comprise cables 258, each connected to one of the carriers 247 (FIG. 31) and extending therefrom through an opening 259 in the vertical arm 244. As illustrated in FIG. 34, the cables 258 may extend over suitably positioned pulley 260 to a common cable connector 261. The connector 261 may be connected directly to motive means, such as a fluid actuated motor means 262. The motor means 262 conveniently receives pressurized working fluid from the liquid pump 51 (FIG. 30) by way of fluid line 263.

It will be observed in FIGS. 31 and 34 that with the motor means 262 deactivated, the springs 250 urge the wheels 252 into engagement with the mullion groove 253. However, when the motor means 262 is activated, the wheels 252 are moved to the retracted or disengaged position illustrated in dash-dot outline in FIG. 31.

OPERATION

Referring to FIG. 27, the aperture 190 of the air knife assembly 187 is maintained spaced-apart from the building exterior wall 48 to provide a gap 218 of approximately five-eighths to seven-eighths of an inch. The air knife assembly 187 provides a high velocity in-rushing air curtain 219 across the gap 218. The air pressure within the lower air distributing duct 182 can be maintained at 9 to 10 inches of water (relative to atmospheric pressure) by means of the centrifugal fan 42 (FIG. 19), thereby to produce a linear air curtain velocity at the gap 218 of 190 to 200 feet per second. Impingement of the liquid spray 154 against the building exterior surface 48 creates liquid drops (not illustrated) which, in the absence of the air curtain 219, would descend along the surface 48. However, the high velocity in-rushing air curtain 219 precludes the egress of the liquid drops from the wall washing site and carries them into the chamber 39 to the outlet passageways 184 (FIG. 28).

The pressure within the chamber 39 can be maintained at minus one-fourth to minus one-half inches of water (relative to atmospheric pressure) by means of the suction created by the centrifugal fan 42 (FIG. 19). It will be observed in FIG. 19 that liquid and air are recirculated to the liquid reservoir 18 through the housing outlets 165 and the reservoir inlets 166. The velocity of the recirculated air is reduced during its passage upwardly through the demister 85. The demister 85 reduces the quantity of entrained liquids carried forwardly into the vortex of the centrifugal fan 42.

The mobile cleaning device 160 performs its wall washing function during the descending movement over the building exterior surface 48. It will be observed in FIG. 27 that during the descending movement, the squeegee elements 192, 193 are disposed in wiping engagement with the building exterior wall 48. The lower squeegee element 193 removes essentially entirely all moisture from the building exterior wall 48.

It will be observed in FIG. 27 that the resilient side rails 194 also are maintained engaged with a building exterior wall 48. Thus the compartment mouth 195*a* is capped, i.e., substantially entirely closed, by the building exterior wall 48. The compartment 195 communicates with the upper air distributing duct 181 by way of the opening 180, whereby the pressure within the compartment 195 is maintained at 9 to 10 inches of water (relative to atmospheric pressure), i.e., at a level above that of the chamber 39.

The essentially close and pressurized condition of the compartment 195 remains intact until such time as the first or lower squeegee element 193 encounters a protrusion, such as the horizontal muntin 14, in the building exterior wall 48. As the lower squeegee element 193 passes over the horizontal muntin 14 (FIG. 28), the lower squeegee element 193 is distorted in such a way that at least one aperture 220 is created between the edge of the squeegee element 193 and the horizontal muntin 14. It will be appreciated that formation of the aperture 200 permits pressurized air, in the form of a high velocity air stream illustrated by the arrow 221, to flow from the compartment 195, through the aperture 220 into the chamber 39. The lower squeegee element 193 also may be deformed in such a way as to produce a second aperture 223 between the edge of the squeegee element 193 and the front muntin face 224. Formation of the second aperture 223 permits pressurized air, in the form of a second high velocity air stream illustrated by the arrows 225, to flow from the compartment 195, through the second aperture 223 into the chamber 39.

Figure 29:
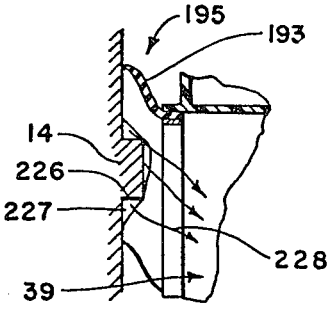
FIG. 29 is a fragmentary cross-sectional view further illustrating the movement of a lower squeegee element over a horizontal outward projection in the building exterior wall surface.

It will be observed in FIG. 29 that as the edge of the lower squeegee element 193 moves below the lower muntin face 226, a third aperture 227 is formed which permits pressurized air, in the form of a third high velocity air stream represented by the arrow 228, to flow from the compartment 195, through the third aperture 227, into the chamber 39.

It will be observed in FIG. 18 that the lower squeegee element 193 as well as the upper squeegee element 192 are inclined with respect to the horizontal. Consequently, as the mobile cleaning device 160 moves downwardly, the first and second apertures 220, 223 (FIG. 28) are initially formed at the left-hand end, as viewed in FIG. 18, of the squeegee element 193. The third aperture 227 (FIG. 29) also is initially formed at the left-hand end, as viewed in FIG. 18, of the squeegee element 193, as the squeegee element 193 passes below the lower muntin face 226 (FIG. 29). It will be appreciated that as the squeegee element 193 moves downwardly, the apertures 220, 223, and 227 are continuously formed and traverse the entire length of the horizontal muntin 14. The high velocity air streams 221, 225, and 228 serve to remove excess liquids from the muntin faces 222, 224, and 226, and to deposit the excess liquids into the chamber 39.

Although not illustrated, apertures similar to the apertures 220, 223, and 227 are formed as the second or upper squeegee element 192 passes across the horizontal muntin 14. However, by the time the upper squeegee element 192 reaches the horizontal muntin 14, substantially entirely all of the excess liquids have been removed and deposited into the chamber 39. Any minute quantities of liquid not removed by the air streams 220, 223 and 227 will be evaporated by similar high velocity air streams produced during distortion of the upper squeegee element 192.

ADDITIONAL OPERATING FEATURES

It will be observed in FIG. 30 that a pressure relief valve 235 is provided in the delivery line 212 for establishing the hydraulic pressure, for example 100 psig, of the system. Should the system pressure exceed the selected operating pressure, the valve 235 reduces the system pressure by bleeding off pressurized liquid — that liquid being returned to the liquid reservoir.

A pressure sensing switch 239 also is provided in the delivery line 212 downstream of the valve 235. The switch 239 communicates an electrical signal to a remote device (not illustrated) situated, for example, on the roof of the building. The remote device provides a visual indication that the pressure level in the delivery line 212 is at the desired level and that the mobile cleaning device is accomplishing its intended wall washing function.

A differential pressure switch 231 is provided in a liquid pressure sensing line 234 having opposite ends communicating with the delivery lines 215, 217*a*. The switch 231 is interconnected electrically with the pump motor 54. Should the filter 216 become clogged to the extent that the pressure differential measured by the switch 231 attains a preselected value, for example 100 psig, the pump motor 51 is deactivated and all active washing is stopped.

The liquid reservoir 18 is provided with vertically spaced apart lower and upper float switches 236, 237 (see also FIG. 19). The lower float switch 236 is interconnected electrically with the pump motor 54. Should the liquid level within the reservoir 18 fall below a preselected level during a washing cycle, the pump motor 54 is deactivated and active washing is terminated. Hence, the lower float switch 236 is activated when an amount of liquid which is insufficient to accomplish the desired washing action remains in the reservoir 18. The upper float switch 237 senses the desired upper level of liquid and is employed during filling of the reservoir 18.

When it is desired to clean the reservoir 18, the filter 216 and the demister 85, the reservoir 18 is emptied by removing the outlet cap 236 (FIG. 30). When the reservoir 18 is drained, purging and filling apparatus (not illustrated) is connected to the coupling 230 provided in the delivery line 217*a*. A solenoid operated shut-off valve 229 provided in the delivery line 217*b* is closed thereby preventing flow of liquid to the liquid pump 51. Thereafter pressurized liquid introduced through the delivery line 217*a* back flushes the filter 216 to remove accumulated solids, the solids are entrained by the pressurized liquid through the delivery line 215 to the manifold 232 and the nozzles 233 carried thereby. A suitable arrangement of check valves 240 and 241 direct the pressurized fluid to manifold 232. The nozzles 233 (see also FIG. 19) provide sprays 242 (FIG. 19) which impinge and thereby clean the demister 85. Initially, the solids removed from the filter 216 are sprayed into the demister 85. Once the filter 216 is clean, spraying of the demister 85 is continued until essentially all solids have been removed and drained from the reservoir 18. The outlet cap 236 is replaced and cleaning liquid is introduced into the reservoir 18 through the nozzles 233. When the desired liquid level is attained, the upper float switch 237 deactivates the filling apparatus. The valve 229 is opened, the filling apparatus is disconnected, and the mobile cleaning device 160 is now ready for service.

I claim:

1. In a building exterior wall washing device, the combination of a housing comprising
- a boundary wall having a forward edge, and
- a rear wall cooperating with said boundary wall to define a chamber;

a sight disposed in an essentially vertical plane defined by the said housing and being essentially unobstructed at the said forward edge of said housing;

liquid distributing means within said chamber for directing liquid through the said sight;

plural spaced apart spacing members located exteriorly of said housing maintaining the said housing in a spaced-apart relation from the said exterior wall;

means for providing a high velocity in-rushing gas curtain at the said forward edge of the said housing to preclude substantial egress of said liquid between the said forward edge and the said exterior wall;

means communicating with said chamber at a location spaced from said forward edge for removing liquid from said chamber; and conduit means for extracting at least a portion of the said gas from the said chamber.

2. The device of claim 1 wherein said spacing means comprises mullion engaging elements which maintain the said sight at a selected distance from the said exterior wall.

3. The device of claim 1 wherein said means for providing a high velocity in-rushing gas curtain comprises a hollow perimeter duct defined in part by the said housing and extending around the said housing;

aperture means disposed along said forward edge of the said housing and communicating with the said hollow perimeter duct outboard of said sight; and delivery means for delivering gas through said aperture means and at a suitable inclination angle as said gas curtain.

4. The device of claim 3 wherein the said inclination angle of the said gas curtain converges at an angle from about 5° to about 20° with respect to the normal.

5. The device of claim 3 wherein the said delivery means for delivering gas is connected to the said conduit means whereby at least a portion of the said gas delivered through the said aperture means is recirculated through the said delivery means.

6. The device of claim 5 wherein the said delivery means is a centrifugal fan.

7. The device of claim 6 wherein the said centrifugal fan has an axis of rotation inclined with respect to the generally vertical plane of the said sight.

8. The device of claim 5 wherein a moisture removing device is disposed within the said conduit means between the said chamber and the said delivery means.

9. The device of claim 1 wherein the said device includes mechanical scrubbing elements positioned within the said chamber and extending forwardly through the said sight to engage the said exterior wall.

10. The device of claim 9 wherein the said mechanical scrubbing elements are mounted for oscillation in a generally horizontal locus.

11. The device of claim 9 wherein the said mechanical scrubbing elements are rotatable about an axis which is generally horizontal and is also generally parallel with the generally vertical plane of the said sight.

12. The device of claim 9 wherein the said mechanical scrubbing elements are bristle containing brushes.

13. The device of claim 9 wherein the said liquid distributing means are disposed both above and below the said mechanical scrubbing elements.

14. The device of claim 9 including platform means for supporting said mechanical scrubbing elements for reciprocal movement through the said sight between a scrubbing position and a retracted position spaced from the said scrubbing position; and resilient means for urging the said mechanical scrubbing elements through the said sight into the said scrubbing position.

15. The device of claim 14 including motor means operable at the termination of a washing cycle for moving the said mechanical scrubbing elements to the said retracted position.

16. The device of claim 14 including motor means responsive to reduced liquid pressure within said liquid distributing means for moving the said mechanical scrubbing elements to the said retracted position.

17. The device of claim 1 wherein said means for providing a high velocity in-rushing gas curtain comprises fan means connected to the said conduit means for evacuating the said chamber whereby atmospheric air is forceably drawn between the said forward edge of the said housing and the said exterior wall, into the said chamber as the said high velocity in-rushing gas curtain.

18. The device of claim 17 wherein the said fan means is a centrifugal fan.

19. The device of claim 18 wherein the said centrifugal fan has an axis of rotation parallel with the general vertical plane of the said sight.

20. The device of claim 17 including second conduit means for extracting at least a portion of the gas discharged from the said fan means; and second aperture means disposed above and outboard of the said sight and communicating with the said second conduit means for delivering a supplementary high velocity gas curtain at a suitable inclination angle against the said exterior well.

21. The device of claim 20 wherein the said second conduit means includes a discharge opening communicating with the armosphere; and proportioning valve means for controlling the volume of extracted gas delivered to the said second aperture means.

22. The device of claim 17 wherein an entrained liquids removing device is disposed within the said conduit means between the said chamber and the said fan means.

23. The device of claim 1 wherein the said boundary wall of the said housing presents flexible forward portions at the said sight.

24. The device of claim 1 wherein the said boundary wall of the said housing presents rigid forward portions at the said sight.

25. In a building exterior wall washing device, the combination of a perimeter duct;

a sight disposed in an essentially vertical plane defined by said perimeter duct;

a chamber defined in part by said perimeter duct and extending rearwardly of said sight;

liquid distributing means within the said chamber for directing liquid through the said sight;

said sight being essentially unobstructed at the forward side of said perimeter duct;

spacing means for maintaining the said perimeter duct in spaced apart relation from the said exterior wall;

aperture means disposed along the forward side of the said perimeter duct and communicating with the said perimeter duct outboard of the said sight;

delivery means for delivering gas through said aperture means at a suitable velocity and inclination angle so as to preclude substantial egress of said liquid between the said perimeter duct and the said exterior wall;

means communicating with said chamber at a location spaced from said forward edge for removing liquid from said chamber; and conduit means for extracting at least a portion of the said gas from the said chamber.

26. The device of claim 25 wherein the said delivery means for delivering gas is connected to the said conduit means whereby at least a portion of the said gas delivered through the said aperture means is recirculated through the said delivery means.

27. The device of claim 26 wherein the said delivery means is a centrifugal fan.

28. The device of claim 27 wherein the said centrifugal fan has an axis of rotation inclined with respect to the generally vertical plane of the said sight.

29. The device of claim 26 wherein a moisture removing device is disposed within the said conduit means between the said chamber and the said delivery means.

30. The device of claim 25 wherein the said device includes mechanical scrubbing elements positioned within the said chamber and extending forwardly through the said sight to engage the said exterior wall.

31. The device of claim 30 wherein the said mechanical scrubbing elements are mounted for oscillation in a generally horizontal locus.

32. The device of claim 30 wherein the said mechanical scrubbing elements are rotatable about an axis which is generally horizontal and is also generally parallel with the generally vertical plane of the said sight.

33. The device of claim 30 wherein the said mechanical scrubbing elements are bristle containing brushes.

34. The device of claim 30 wherein the said liquid distributing means are disposed both above and below the said mechanical scrubbing elements whereby the device will perform its wall washing function during both ascending and descending movement.

35. The device of claim 25 wherein said spacing means comprises mullion engaging elements which maintain the said sight at a selected distance from the said exterior wall.

36. The device of claim 25 wherein the said inclination angle of the gas converges at an angle from about 5° to about 20° with respect to the normal.

37. In a building exterior wall washing device, the combination of a housing including a boundary wall having a forward edge; and a rear wall cooperating with said boundary wall to define a chamber;

a sight disposed in an essentially vertical plane defined by said housing and being essentially unobstructed at said forward edge of said housing;

liquid distributing means within said chamber for directing liquid through said sight;

means for removing liquid from said chamber;

spacing means for maintaining said housing in spaced-apart relation from said exterior wall;

means for precluding substantial egress of said liquid between said forward edge and said exterior wall, including a high velocity in-rushing gas curtain at said forward edge along the bottom of said chamber;

conduit means for extracting at least a portion of said gas from said chamber;

a compartment formed in said housing above said chamber and presenting a mouth adapted to be capped by said exterior wall;

resilient means surrounding said mouth; and pressurizing means communicating with said compartment for maintaining the gas pressure within said compartment at a level above that of said chamber.

38. The device of claim 37 wherein said mouth is positioned obliquely with respect to the direction of travel of said mobile cleaning device.

39. The device of claim 38 including journal means for supporting said housing for reciprocal movement between an operating position and a retracted position spaced from said operating position; and motor means operable at the start of a washing cycle for moving said housing to said operating position.

40. The device of claim 37 wherein said resilient means surrounding said mouth comprises first flexible means disposed along one side of said mouth adjacent to said chamber;

second flexible means spaced from said first flexible means and disposed along that side of said mouth remote from said chamber; and resilient side rails, one disposed at each end of said mouth and extending between the ends of said first flexible means and said second flexible means.

41. The device of claim 40 wherein said first flexible means is positioned obliquely with respect to the direction of travel of said mobile cleaning device.

42. The device of claim 41 wherein said second flexible means is positioned obliquely with respect to the direction of travel of said mobile cleaning device.

43. The device of claim 37 wherein said means for providing a high velocity in-rushing gas curtain comprises aperture means at said forward edge extending across the bottom of said chamber;

duct means formed in said housing and communicating with said aperture means outboard of said site; and delivery means for delivering gas through said duct means and through said aperture means and at a suitable inclination angle as said gas curtain.

44. The device of claim 43 wherein said compartment communicates with said duct means and is pressurized by said delivery means.

45. The device of claim 43 wherein said inclination angle of said gas curtain converges at an angle from about 5 to about 20 degrees with respect to the normal.

46. The device of claim 43 wherein said delivery means for delivering gas is connected to said conduit means whereby at least a portion of said gas delivered through said aperture means is recirculated through said delivery means.

47. The device of claim 46 wherein said delivery means is a centrifugal fan.

48. The device of claim 46 wherein a moisture removing device is disposed within said conduit means between said chamber and said delivery means.

49. The device of claim 37 wherein said device includes mechanical scrubbing elements positioned within said chamber and extending forwardly through said site to engage said exterior wall.

50. The device of claim 49 wherein said mechanical scrubbing elements are mounted for oscillation in a generally horizontal locus.

51. The device of claim 49 wherein said mechanical scrubbing elements are bristle containing brushes.

52. The device of claim 49 wherein said liquid distributing means are disposed above and below said mechanical scrubbing elements.

53. The device of claim 37 wherein said spacing means comprises mullion engaging elements which maintain said sight at a selected distance from said exterior wall.

54. The device of claim 53 including means for disengaging said mullion engaging elements.

55. The device of claim 54 including resilient elements for urging said housing into said retracted position.

56. In a building exterior wall washing device, the combination of a housing comprising a boundary wall having a forward edge, and a rear wall cooperating with said boundary wall to define a chamber;

a sight disposed in an essentially vertical plane defined by the said housing and being essentially unobstructed at the said forward edge of said housing;

liquid distributing means within said chamber for directing liquid through the said sight;

spacing means located exteriorly of said housing for maintaining the said housing in a spaced-apart relation from the said exterior wall;

means for precluding substantial egress of said liquid between the said forward edge of said housing and the said exterior wall, including a high velocity inrushing gas curtain at the said forward edge;

said means for precluding substantial egress of said liquid being distinct from said spacing means;

means communicating with said chamber at a location spaced from said forward edge for removing liquid from said chamber; and conduit means for extracting at least a portion of the said gas from the said chamber.

* * * * *